US006882109B2

(12) United States Patent
Nakano et al.

(10) Patent No.: US 6,882,109 B2
(45) Date of Patent: Apr. 19, 2005

(54) ELECTRIC DISCHARGE LAMP

(75) Inventors: Kuniaki Nakano, Kyoto (JP); Jiro Honda, Kyoto (JP); Shigeyuki Mori, Kyoto (JP); Yasaburo Takeji, Kyoto (JP); Shinji Taniguchi, Kyoto (JP)

(73) Assignee: Japan Storage Battery Co., Ltd., Kyoto (JP)

( * ) Notice: Subject to any disclaimer, the term of this patent is extended or adjusted under 35 U.S.C. 154(b) by 245 days.

(21) Appl. No.: 09/959,808

(22) PCT Filed: Mar. 8, 2001

(86) PCT No.: PCT/JP01/01837

§ 371 (c)(1),
(2), (4) Date: Nov. 8, 2001

(87) PCT Pub. No.: WO01/67488

PCT Pub. Date: Sep. 13, 2001

(65) Prior Publication Data

US 2002/0185974 A1 Dec. 12, 2002

(30) Foreign Application Priority Data

| | | |
|---|---|---|
| Mar. 8, 2000 | (JP) | 2000-063527 |
| Mar. 8, 2000 | (JP) | 2000-063539 |
| May 30, 2000 | (JP) | 2000-160682 |
| May 31, 2000 | (JP) | 2000-163113 |
| May 31, 2000 | (JP) | 2000-163674 |
| Jun. 1, 2000 | (JP) | 2000-164521 |
| Jun. 2, 2000 | (JP) | 2000-166007 |
| Jun. 21, 2000 | (JP) | 2000-186157 |

(51) Int. Cl.[7] ..... H01J 61/36
(52) U.S. Cl. ..... 313/625; 313/288; 313/332
(58) Field of Search ..... 313/623–625, 313/332, 570, 571, 288, 289, 356, 354, 238, 242, 250, 256, 504, 506, 252, 283; 427/66, 377; 445/24, 58; 428/446, 698, 448

(56) References Cited

U.S. PATENT DOCUMENTS

| | | | | |
|---|---|---|---|---|
| 4,076,991 A | | 2/1978 | Datta | |
| 4,160,930 A | * | 7/1979 | Driessen et al. | 313/283 |
| 4,694,219 A | * | 9/1987 | Hing | 313/636 |
| 5,424,609 A | * | 6/1995 | Geven et al. | 313/623 |
| 5,994,839 A | * | 11/1999 | Yamamoto et al. | 313/570 |
| 6,075,314 A | * | 6/2000 | Huettinger et al. | 313/332 |
| 6,259,205 B1 | * | 7/2001 | Wijenberg et al. | 313/625 |
| 6,495,959 B1 | * | 12/2002 | Ikeuchi et al. | 313/623 |

FOREIGN PATENT DOCUMENTS

| | | |
|---|---|---|
| JP | 53-138419 | 12/1978 |
| JP | A6-196131 | 7/1994 |
| JP | A8-273595 | 10/1996 |
| JP | A9-213272 | 8/1997 |
| JP | A11-96973 | 4/1999 |
| JP | A11-162411 | 6/1999 |

* cited by examiner

*Primary Examiner*—Vip Patel
*Assistant Examiner*—Glenn D. Zimmerman
(74) *Attorney, Agent, or Firm*—Birch, Stewart, Kolasch & Birch, LLP.

(57) ABSTRACT

The reliability of the airtight sealed section is improved by providing a metallic or ceramic insertion member at a portion positioned between an electricity introducing member and a narrow tube in the airtight sealed section. The difference between the inner diameter of the narrow tube and the outer diameter of the insertion member is made 0.02 to 0.6 mm. The electricity introducing member is constructed by a halogen-resistant first member and a second member whose coefficient of linear expansion is similar to that of the narrow tube, and the junction of the first member and second member is covered with a halogen-resistant glass sealant. The difference between the insertion length of the second member into the narrow tube and the flow-in length of the glass sealant into the narrow tube is made 1 mm or more.

33 Claims, 17 Drawing Sheets

ELECTRIC DISCHARGE LAMP

This application is the national phase under 35 U.S.C. § 371 of PCT International Application No. PCT/JP01/01837 which has an International filing date of Mar. 8, 2001, which designated the United States of America.

TECHNICAL FIELD

The present invention relates to an electric discharge lamp using a translucent ceramic tube for an arc tube, and more particularly to an improvement of the sealing structure at the ends of the arc tube.

BACKGROUND ART

Conventionally, a quartz glass has been used for an arc tube material of high-pressure electric discharge lamps, but, in recent years, high-pressure electric discharge lamps using translucent ceramics for the arc tube material have been developed as products. In the high-pressure electric discharge lamps, particularly, metal halide lamps, when the arc tube material is a quartz glass, the quartz glass and metal halide as a light emitting substance gradually react during lighting and create the cause of degradation of the life characteristic. However, when the arc tube material is translucent ceramic, since it hardly reacts with the metal halide, a better life characteristic than that of the arc tube made of the quartz glass is obtained and the arc tube can be made compact, thereby creating a possibility of producing a lamp having good luminous efficiency and color rendering property. For such reasons, in recent years, electric discharge lamps using translucent ceramics for the arc tube material have been put into practical applications.

As a conventional example of the sealing structure of the arc tube of an electric discharge lamp using a ceramic tube, one shown in FIG. 1 and disclosed in Japanese Patent Application Laid-Open No. 6-196131 (1994) has been known. The arc tube is constructed by a wide tube 11 made of translucent ceramic and narrow tubes 12 made of the same translucent ceramic and provided at both ends of the wide tube 11. An electricity introducing member constructed by a first electricity introducing member 24 and a second electricity introducing member 27 is inserted into the narrow tube 12. The first electricity introducing member 24 is formed of a halogen-resistant electricity introducing member, such as molybdenum and cermet. The second electricity introducing member 27 is formed of an electricity introducing member having no halogen resistance, such as niobium. The first electricity introducing member 24 and the second electricity introducing member 27 were butt-welded at a welding section 26. Moreover, an electrode is constructed by an electrode core 21 butt-welded to the first electricity introducing member 24 at a welding section 25 and a coil 20 wound round the electrode core 21.

The first electricity introducing member 24 holding the electrode core 21, the second electricity introducing member 27 and the narrow tube 12 are airtightly sealed with a halogen-resistant sealing glass 30. The second electricity introducing member 27 is protected from halogen corrosion by covering its portion inserted into the narrow tube 12 with the halogen-resistant sealing glass 30. Furthermore, a part of the first electricity introducing member 24 is also covered with the sealing glass 30.

In the electric discharge lamp using translucent ceramic, it is difficult to highly reliably form the sealed sections of the electricity introducing member at the ends and the difficulty particularly increases as the diameter of the end becomes larger, and thus the conventional structure as described above has a drawback that it is not applicable to electric discharge lamps of large electric power consumption. In general, in an electric discharge lamp, the larger the electric power consumption is, the larger the current flows, but it is necessary to increase the diameter of the electrode core 21 constituting the electrode for a flow of a large current. In the above-described structure, if the diameter of the electrode core 21 is to be increased, the inner diameter of the narrow tube 12 must be increased.

However, when the inner diameter of the narrow tube 21 is increased, the gap between the electricity introducing member (the first electricity introducing member 24 and second electricity introducing member 27) and the narrow tube 12 becomes larger, resulting in difficult sealing. In other words, since the large gap between the electricity introducing member and the narrow tube 12 is filled with the sealing glass 30, a leakage of airtightness from the thicker layer of the sealing glass 30 is likely to occur.

In general, the thinner the layer thickness of the sealing glass 30, the higher the heat resistance of the sealed section, but, if the conventional structure is applied to a lamp of large electric power consumption, the layer thickness is unavoidably increased, resulting in problems that the narrow tube 12 will crack during sealing and, even when sealing is satisfactorily achieved, a leakage of airtightness from the layer of the sealing glass 30 will occur at an early stage due to the heat cycle by switching the lamp on and off.

In order to avoid such problems, it can be considered to increase the inner diameter of the narrow tube 12 and the diameter of the electricity introducing member. In this method, however, satisfactory sealing can not be achieved because of a difference in the coefficients of linear expansion between the different materials of the electricity introducing member and the narrow tube 12. Therefore, the conventional structure can be applied to lamps whose narrow tube 12 has an inner diameter smaller than 1.3 mm and electric power consumption is relatively small, not more than 150 W, but it cannot be applied to lamps of electric power consumption of more than 150 W.

For the sealing glass 30, two kinds of materials have been used conventionally: a material having a composition of $Al_2O_3$: 30 weight %, $SiO_2$: 40 weight % and $Dy_2O_3$: 30 weight %, which has poor retention of airtightness but has excellent halogen resistance, for a side facing the discharge space; and a material having a composition of $Al_2O_3$: 13 weight %, $SiO_2$: 37 weight % and $Dy_2O_3$: 50 weight %, which has poor halogen resistance but has excellent retention of airtightness, for a side that does not face the discharge space. Since such two kinds of materials are used for the sealing glass 30, it is necessary to divide the sealing process into two stages, resulting in problems that the sealing process becomes complicated and unsuitable for mass-production.

The present invention has been made on the basis of the above circumstances, and its object is to provide an electric discharge lamp capable of increasing the reliability of the sealed section of an arc tube for discharge and improving the life characteristic.

Another object of the present invention is to provide an electric discharge lamp having the sealed section of good reliability, excellent life and large electric power consumption.

Still another object of the present invention is to provide an electric discharge lamp capable of improving the reliability of the sealed section and the mass-productivity of the sealing process.

DISCLOSURE OF THE INVENTION

In an electric discharge lamp of the present invention, an arc tube made of translucent ceramic with a small-diameter section formed at both ends is used, an electricity introducing member is inserted into the small-diameter section, an airtight sealed section where the electricity introducing member is airtightly fixed by a glass sealant is formed, an insertion member is provided between the electricity introducing member and the small-diameter section, and the glass sealant fills spaces between the electricity introducing member and the insertion member and between the insertion member and the small-diameter section.

By constructing the electric discharge lamp in such a manner, even if the diameter of the electricity introducing member and the inner diameter of the small-diameter section are increased so as to insert a large electrode into the small-diameter section, since the insertion member is provided therebetween, the layer thickness of the glass sealant formed between the electricity introducing member and the small-diameter section does not increase. It is thus possible to prevent the small-diameter section from cracking during sealing and prevent a leakage of airtightness from the layer of the glass sealant at an early stage due to the heat cycle by switching the lamp on and off, thereby retaining the reliability of the airtight sealed section. As a result, it becomes also possible to realize an electric discharge lamp of large electric power consumption. In particular, when the small-diameter section is made of a narrow tube, since the electrode diameter increases, the inner diameter of the narrow tube tends to be larger than the diameter of the electricity introducing member, and therefore it becomes possible to retain the reliability of the airtight sealed section more effectively.

In an electric discharge lamp having such a structure, as the translucent ceramic used for the arc tube, it is possible to use, for example, translucent alumina, sapphire, yttria, yttrium.aluminum.garnet, aluminum nitride, etc., and from the viewpoint of the prices and translucent properties, it is preferred to use translucent alumina and aluminum nitride, and more preferred to use translucent alumina.

Further, the glass sealant is a mixture containing $A_2O_3$, $SiO_2$, and an oxide of a rare-earth element (particularly, $Dy_2O_3$), and the weight ratio of $Al_2O_3$: 17±3 weight %, $SiO_2$: 22±3 weight % and $Dy_2O_3$: 61±3 weight % is especially preferred. Note that this $Al_2O_3$—$SiO_2$—$Dy_2O_3$ based mixture is not necessarily composed of only three components, and if the weight ratio of the respective components is within the above-mentioned numerical range, components other than these three components may be contained. As the other components, it is possible to use, for example, molybdenum oxide, scandium oxide, yttrium oxide, magnesium oxide, etc. Since the glass sealant having such a composition is used, it is possible to provide a long-life electric discharge lamp having excellent halogen resistance and reliability in the sealed section. The glass sealant having such a composition excels in both the characteristics of halogen resistance and retention of airtightness. Accordingly, both of these excellent characteristics are achieved by this one kind of glass sealant and the sealing operation is completed by a single sealing process, thereby improving the reliability of the sealed section and the mass-productivity of the sealing process.

Besides, for this insertion member, it is possible to use a heat-resistant metal, ceramic or cermet. When a heat-resistant metal is used, the insertion member performs the function of a stress buffering member and this insertion member (stress buffering member) absorbs thermal stress that is based on the difference in the coefficients of linear expansion between the glass sealant and the electricity introducing member and applied to the airtight sealed section airtightly fixed by the glass sealant, thereby preventing a crack in the glass sealant in the airtight sealed section due to the heat cycle by switching the lamp on and off. Further, if such a crack is not caused, a leakage of airtightness in the sealed section does not occur, thereby improving the life characteristic of the lamp. Preferred examples of such a heat-resistant metal are metals whose coefficient of linear expansion at 0 to 1000° C. is $6.5\times10^{-6}$/° C. or more, namely niobium, tantalum, iridium, rhodium, vanadium, titanium, platinum, alloys of niobium, alloys of tantalum, alloys of iridium, alloys of rhodium, alloys of vanadium, alloys of titanium and alloys of platinum. When such a heat-resistant metal is used, since it has a coefficient of linear expansion very similar to that of ceramic and is soft metal that can be readily deformed, it is suitable for the stress buffering member for absorbing thermal stress generated between different kinds of materials, and the sealed section is reinforced.

In the case of using ceramic as the material of the insertion member, when one which is the same ceramic as that used for forming the arc tube (the small-diameter section) or one having a similar coefficient of linear expansion is used, the sealed section is further reinforced, and therefore it is preferred to use such ceramics. Note that the similar coefficient of linear expansion means that the difference from the coefficient of linear expansion of the ceramic forming the arc tube (the small-diameter section) is within 25%, and the closer the coefficient, the better the result obtained. Preferred examples of such ceramics are ceramics whose coefficient of linear expansion at 20 to 1000° C. is $8.9\times10^{-6}$/° C. or less, namely ceramics comprising at least one kind of alumina, titania, spinel, beryllia, etc. Further, the ceramic insertion member in cylindrical shape is particularly preferable, and a so-called ceramic sleeve is preferable.

Besides, it is also possible to construct the insertion member by a single layer or a plurality of layers of ceramic sleeve made of ceramic as mentioned above and a single layer or a plurality of layers of heat-resistant layer made of a heat-resistant metal as mentioned above.

In the case where the insertion member is formed of a ceramic sleeve, it is preferred to wind a metallic coil round the electrode core in the small-diameter section rather than covering the electrode core completely with this ceramic sleeve. The reason for this is to enable heat generated at the tip of the electrode to be effectively transmitted to the rear side because metals have a higher thermal conductivity compared to ceramics.

In the case where the insertion member is formed of a ceramic sleeve and the small-diameter section is formed of a narrow tube, it is necessary to satisfy $0.02 \leqq A-B \leqq 0.60$ (mm), where A (mm) is the inner diameter of the narrow tube and B (mm) is the outer diameter of the ceramic sleeve. By achieving such a structure, it is possible to prevent a crack from being produced in the sealed section during the sealing process.

Moreover, in the case where the electricity introducing member is made of one kind of metal material, preferred materials are tungsten, molybdenum, alloys of tungsten, alloys of molybdenum, etc.

It is also possible to construct the electricity introducing member by a halogen-resistant first member connected to the electrode (the electrode core) and a second member whose coefficient of linear expansion is similar to that of translucent ceramic used for the arc tube (the small-diameter section). In this case, the insertion member is provided between the first member and the small-diameter section, and the junction between the first and second members made by welding, for example, is covered with the glass sealant. By using the second member whose coefficient of linear expansion is similar to that of translucent ceramic used for the arc tube (the small-diameter section), it is possible to reduce distortion due to the difference between the coefficients of linear expansion, more effectively prevent a crack in the small-diameter section and prevent a leakage of airtightness from the layer of the glass sealant.

Note that the similar coefficient of linear expansion means that the difference of the coefficient of linear expansion of the second member from the coefficient of linear expansion of the translucent ceramic is preferably within 25% of the value of the coefficient of linear expansion of the translucent ceramic, and the closer the coefficient, the better the result obtained. In addition, like the above, it is preferred that the insertion member and translucent ceramic, and the insertion member and second member have similar coefficients of linear expansion, respectively, and it is more preferred that the difference between the maximum value and the minimum value of the three coefficients of linear expansion of the translucent ceramic, insertion member and second member is within 25% of the value of the coefficient of linear expansion of the translucent ceramic.

When the inner diameter of the narrow tube as the small-diameter section is 1.3 mm or more, it is necessary to satisfy $D-C \geqq 1.0$ (mm), where C (mm) is the insertion length of the second member on the rear-end side of the electricity introducing member into the narrow tube and D (mm) is the flow-in length of the glass sealant into the narrow tube. Since the inner diameter of the narrow tube is made 1.3 mm or more, it is possible to insert a large electrode into the narrow tube and enable practical application of a lamp of large electric power consumption. Moreover, since the lamp is constructed to satisfy $D-C \geqq 1.0$ (mm), it is possible to prevent a chemical reaction of the filler containing a metal halide and capable of being ionized in the arc tube with the second member and to provide an electric discharge lamp with excellent reliability in the sealed section and excellent life characteristic.

In such a structure, for the first member, it is possible to use molybdenum, alloys of molybdenum, cermet, etc. It is particularly preferred that the first member is molybdenum or an alloy of molybdenum with a diameter of not less than 0.3 mm but not more than 0.7 mm. By forming the first member by such a material, it is possible to prevent a leakage of airtightness in the layer of the glass sealant at a section connected to the first member.

Besides, for the second member, it is possible to use niobium, alloys of niobium, tantalum, alloys of tantalum, etc. By forming the second member by such a material, it is possible to prevent a leakage of airtightness in the layer of the glass sealant at a section connected to the second member.

PREFERRED EMBODIMENTS OF THE INVENTION

The following description will explain the present invention in detail with reference to the drawings illustrating some embodiments thereof.

Figure 2:
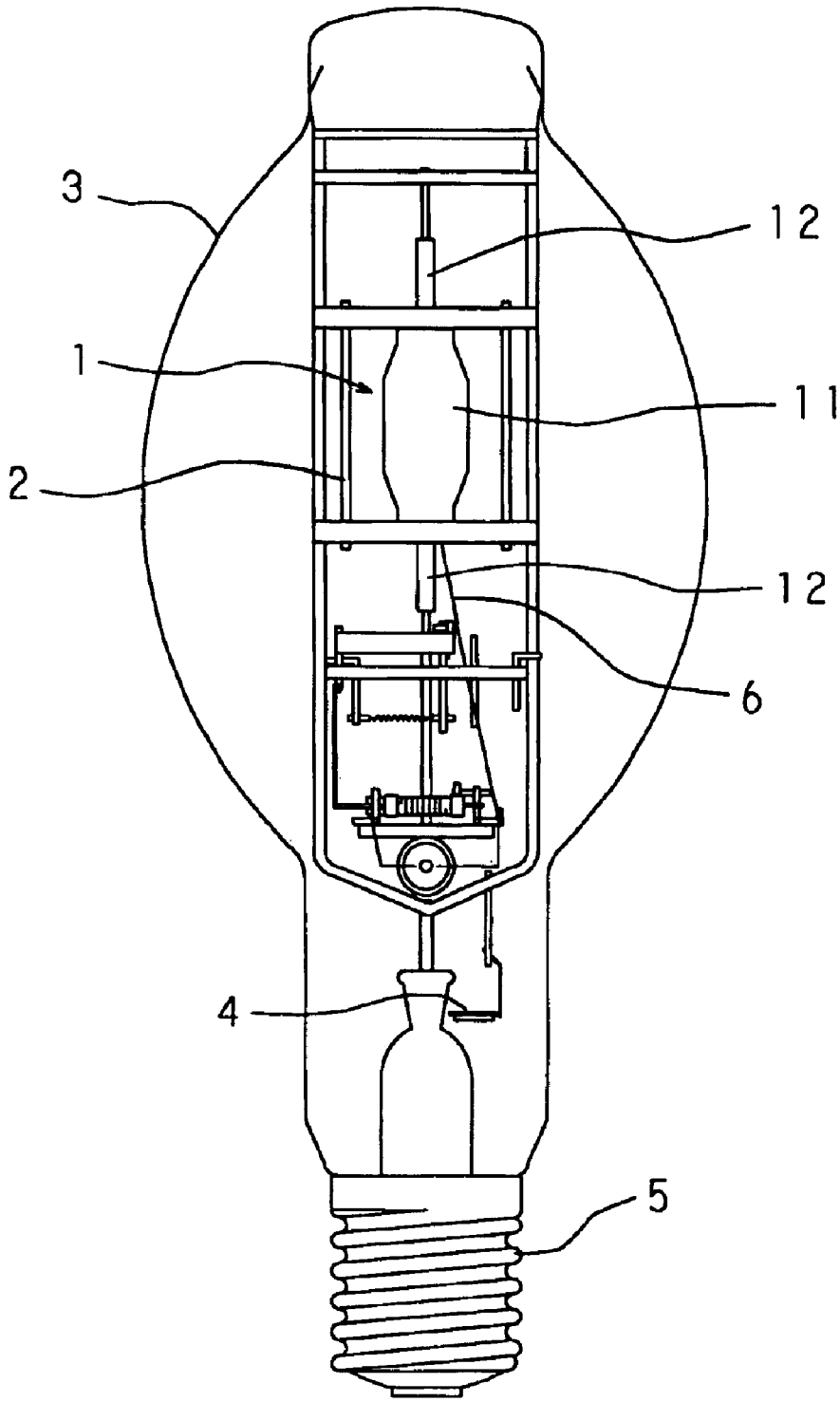
FIG. 2 is a cross sectional view showing the entire schematic structure of an electric discharge lamp of the present invention.

FIG. 2 is a cross sectional view showing the entire schematic structure of an electric discharge lamp of the present invention. In FIG. 2, 1 is an arc tube, 2 is a cylinder made of quartz glass, 3 is an external tube made of hard glass, 4 is a getter, 5 is a base, 6 is a guide member formed by arranging a metal wire along the arc tube 1 to facilitate starting, 11 is a wide tube of the arc tube 1, and 12 is a narrow tube of the arc tube.

The following description will explain various structures of the arc tube 1 of electric discharge lamp, which are the characteristic features of the present invention.

(First Embodiment)

Figure 3:
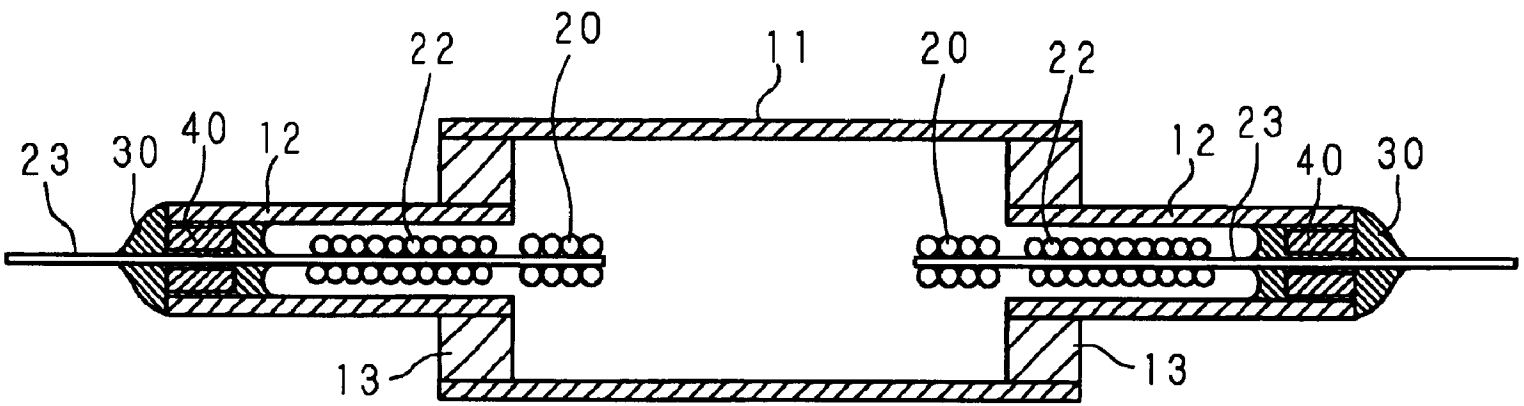
FIG. 3 is a cross sectional view showing the structure of the arc tube of an electric discharge lamp according to the first embodiment.

FIG. 3 is a cross sectional view showing the structure of the arc tube 1 of an electric discharge lamp according to the first embodiment of the present invention. In FIG. 3, at both ends of the wide tube 11 made of translucent ceramic, the narrow tube 12 made of the same translucent ceramic and forming a small-diameter section is airtightly mounted through a disk 13 made of translucent ceramic. Specifically, this translucent ceramic is a translucent alumina. A filler containing a metal halide and capable of being ionized is enclosed in the arc tube 1.

An electricity introducing member 23 made of tungsten that also serves as an electrode core is inserted into this narrow tube 12. A first coil 20 and a second coil 22 are wound round portions of the electricity introducing member 23, which function as the electrode core. The aim of the first coil 20 is to protect the electrode from high temperature at an arc spot formed at the tip of the electrode when the lamp is lit, while the aim of the second coil 22 is to facilitate release of heat at the tip of the electrode toward the rear side of the electrode.

A stress buffering member 40 in the form of a tube made of niobium as an insertion member is provided between the outer end of the narrow tube 12 and the electricity introducing member 23, and the narrow tube 12, stress buffering member 40 and electricity introducing member 23 are airtightly fixed by a halogen-resistant sealing glass 30. In other words, the sealing glass 30 fills spaces between the electricity introducing member 23 and the stress buffering member 40 and between the stress buffering member 40 and the narrow tube 12.

As the ceramic material used for the arc tube 1 (the wide tube 11, narrow tube 12 and disk 13), in addition to translucent alumina, it is possible to use sapphire, yttria, yttrium.aluminum.garnet, aluminum nitride, etc. Moreover, as the material of the electricity introducing member 23, in addition to tungsten, it is possible to use molybdenum, niobium, tantalum, rhenium, platinum, alloys of tungsten, alloys of molybdenum, etc.

As the sealing glass 30, it is possible to use $Al_2O_3$—$SiO_2$ based or $Al_2O_3$—CaO—BaO based glass materials, for example, and it is preferred to form an airtight sealed section at the outer end of the narrow tube 12. Note that, as the sealing glass 30 for an electric discharge lamp in which a metal halide is enclosed, an $Al_2O_3$—$SiO_2$ based material is more preferable, and a material formed of a mixture containing $Al_2O_3$, $SiO_2$ and an oxide of a rare-earth element ($Dy_2O_3$ is particularly preferable) is especially preferable. The sealing glass 30 of this embodiment is formed by a mixture of $Al_2O_3$, $SiO_2$ and $Dy_2O_3$, and the composition ratio is, in this order, 17±3 weight %, 22±3 weight % and 61±3 weight %. When the weight ratio of the respective components satisfies this numerical range, the sealing glass 30 may contain molybdenum oxide, scandium oxide, yttrium oxide, magnesium oxide, etc. as other components. With such a composition, the characteristics of the sealing glass 30 are the melting point: 1,390° C. and the coefficient of linear expansion: $6.5\times10^{-6}$/° C., thereby realizing both the halogen resistance and the reliability of sealing. When the composition of the sealing glass 30 is out of the above-mentioned range, the following problems occur.

When the composition of the sealing glass 30 is out of the above-mentioned range, the melting point becomes higher, and the heating temperature in the sealing process needs to be no lower than 50° C. When the sealing temperature is increased, since the temperature of the arc tube 1 as a whole rises, a part of mercury and metal halide enclosed in the arc tube 1 evaporates and is lost. When a part of the enclosed material is lost, various characteristics of the fabricated electric discharge lamp do not fall in the designed values. When the composition of the sealing glass 30 is within the above-mentioned range, such a problem does not occur and an electric discharge lamp having various characteristics satisfying the designed values can be fabricated. On the other hand, when the composition of the sealing glass 30 is out of the above-mentioned range, the coefficient of linear expansion changes and the thermal shock resistance of the sealed section lowers. When the coefficient of linear expansion changes, the balance of the coefficients of linear expansion of the narrow tube 12, electricity introducing member 23 and sealing glass 30 is lost, and the sealing glass 30 will crack by thermal shock caused by repetition of switching the lamp on/off.

Accordingly, a mixture of $Al_2O_3$—$SiO_2$—$Dy_2O_3$ based metal oxides having the composition ratio of $Al_2O_3$: 17±3 weight %, $SiO_2$: 22×3 weight % and $Dy_2O_3$: 61±3 weight % (hereinafter this composition ratio will be referred to as the optimum composition ratio) is most suitable for the sealing glass 30.

Note that for the stress buffering member 40 made of metal, in addition to niobium, it is also possible to use other kinds of metals. The present inventor et al. produced trial products of four kinds of electric discharge lamps whose stress buffering members 40 were made of niobium, tantalum, molybdenum, and tungsten, respectively, and found as a result of lighting experiments that the lamps using niobium and tantalum had no problems, but the narrow tubes 12 of the lamps using molybdenum and tungsten cracked due to differences in the coefficients of linear expansion. The coefficients of linear expansion of these metals at 0 to 1,000° C. are niobium: $6.9\times10^{-6}$/° C., tantalum: $6.5\times10^{-6}$/° C., molybdenum: $5.5\times10^{-6}$/° C., and tungsten: $5.1\times10^{-6}$/° C., and a preferred coefficient of linear expansion is not lower than $6.5\times10^{-6}$/° C. As such a metal that can withstand high temperature, in addition to the above-mentioned niobium and tantalum, it is also possible to use iridium (the coefficient of linear expansion: $6.8\times10^{-6}$/° C. at 0 to 100° C.), rhodium (the coefficient of linear expansion: $8.3\times10^{-6}$/° C. at 20 to 100° C.), vanadium (the coefficient of linear expansion: $8.3\times10^{-6}$/° C. at 23 to 100° C.), titanium (the coefficient of linear expansion: $8.5\times10^{-6}$/° C. at 25° C.), platinum (the coefficient of linear expansion: $8.9\times10^{-6}$/° C. at 0° C.), and alloys of these metals.

Note that, as the stress buffering member 40 to be used, one having a coefficient of thermal expansion between the coefficient of thermal expansion of the electricity introducing member 23 and the coefficient of thermal expansion of ceramic forming the small-diameter section (narrow tube 11) or the same as the coefficient of thermal expansion of ceramic forming the small-diameter section (narrow tube 11) is preferable, and one having a coefficient of thermal expansion closer to the coefficient of thermal expansion of ceramic forming the small-diameter section (narrow tube 11) than to the coefficient of thermal expansion of the electricity introducing member 23 is more preferable. Further, one having a coefficient of thermal expansion which is larger than the coefficient of thermal expansion of the electricity introducing member 23 but is not larger than the coefficient of thermal expansion of ceramic forming the small-diameter section (narrow tube 11) is more preferable, and one having a coefficient of thermal expansion closer to the coefficient of thermal expansion of the ceramic than to the coefficient of thermal expansion of the electricity introducing member 23 is still more preferable. Besides, it is most preferred that the coefficients of thermal expansion of the electricity introducing member 23, the sealing glass 30, the stress buffering member 40 and the ceramic forming the small-diameter section (narrow tube 11) increase in this order (the electricity introducing member has the smallest coefficient of thermal expansion).

(Second Embodiment)

Figure 4:
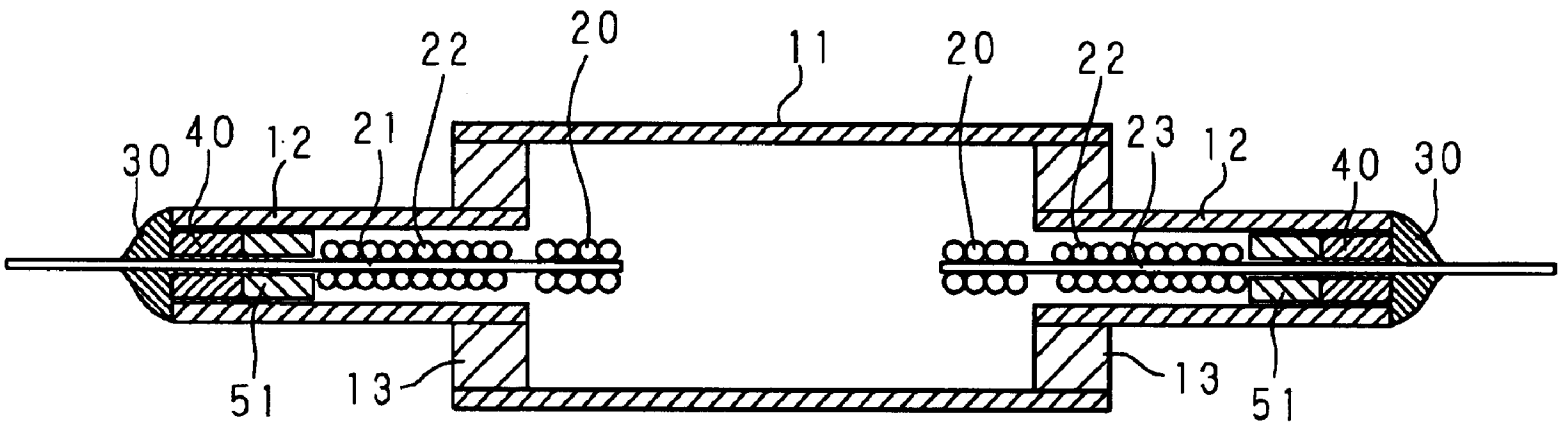
FIG. 4 is a cross sectional view showing the structure of the arc tube of an electric discharge lamp according to the second embodiment.

FIG. 4 is a cross sectional view showing the structure of the arc tube 1 of an electric discharge lamp according to the second embodiment of the present invention. In FIG. 4, the same sections as in FIG. 3 are designated with the same numbers, and the explanation thereof is omitted. In the second embodiment, a ceramic tube 51 for positioning the stress buffering member 40 is mounted between the outer end of the narrow tube 12 and the electricity introducing member 23, and the stress buffering member 40 is positioned by the second coil 22 through the ceramic tube 51. The sealing glass 30 fills up to a position in the ceramic tube 51 several mm from its end on the stress buffering member 40 side.

(Third Embodiment)

Figure 5:
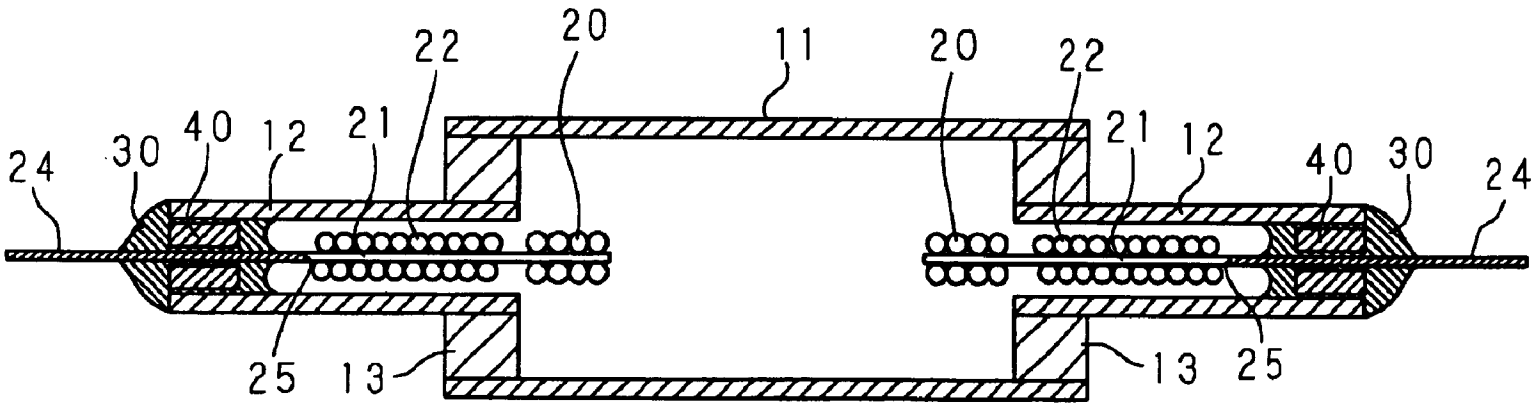
FIG. 5 is a cross sectional view showing the structure of the arc tube of an electric discharge lamp according to the third embodiment.

FIG. 5 is a cross sectional view showing the structure of the arc tube 1 of an electric discharge lamp according to the third embodiment of the present invention. In FIG. 5, the same sections as in FIG. 3 are designated with the same numbers, and the explanation thereof is omitted. In the third embodiment, the electrode core 21 made of tungsten and the electricity introducing member 24 made of molybdenum which were butt-welded at the welding section 25 are inserted into the narrow tube 12.

By using molybdenum as the electricity introducing member 24, the reliability of the sealed section is further improved compared to the use of tungsten. The reason for this is that the coefficient of linear expansion of molybdenum is closer to that of ceramic (particularly, translucent alumina) as compared to tungsten. Moreover, among molybdenum, molybdenum containing 0.1 to 1.0 weight % of lanthanum or lanthanum oxide is preferable because embrittlement due to the growth of recrystallized particles at high temperature hardly occurs and it is superior as the electricity introducing member 24. Furthermore, it is also possible to use an alloy of molybdenum and rhenium as the electricity introducing member 24. In addition, a cermet imparted with the conductivity by molding and sintering a mixture of alumina and molybdenum can also be used as the electricity introducing member 24.

(Fourth Embodiment)

Figure 6:
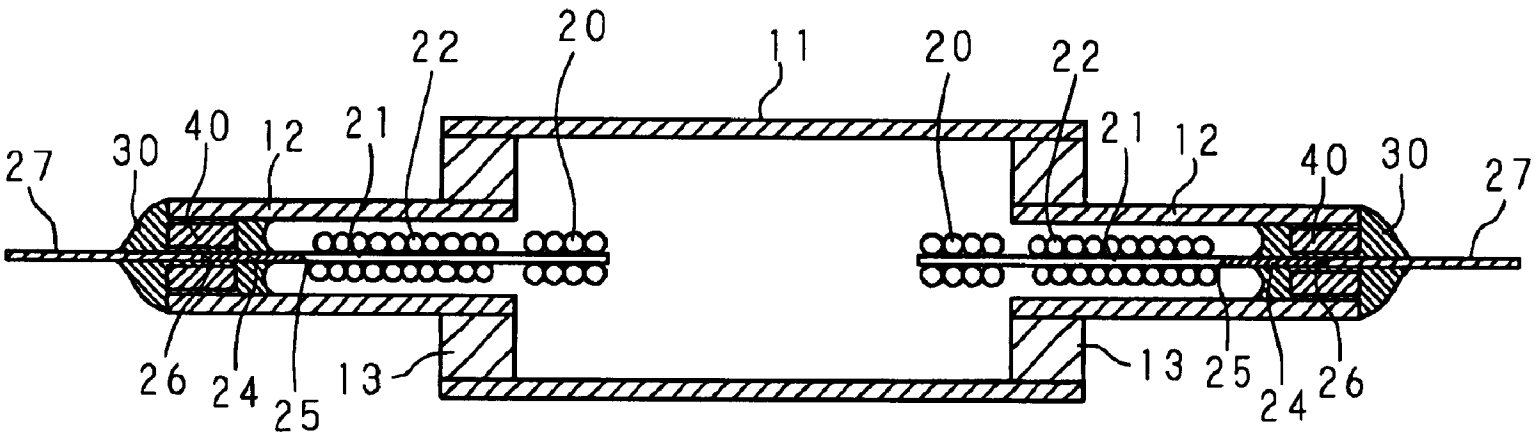
FIG. 6 is a cross sectional view showing the structure of the arc tube of an electric discharge lamp according to the fourth embodiment.

FIG. 6 is a cross sectional view showing the structure of the arc tube 1 of an electric discharge lamp according to the fourth embodiment of the present invention. In FIG. 6, the same sections as in FIG. 5 are designated with the same numbers, and the explanation thereof is omitted. In the fourth embodiment, the electricity introducing member is constructed by the first electricity introducing member 24 as the first member and the second electricity introducing member 27 as the second member. Like the third embodiment, the electrode core 21 and the first electricity introducing member 24 were butt-welded at the welding section 25, and the first electricity introducing member 24 and the second electricity introducing member 27 were butt-welded at the welding section 26.

As the first electricity introducing member 24, like the third embodiment, it is possible to use molybdenum, alloys of molybdenum, cermets, etc. The second electricity introducing member 27 needs to have a material characteristic of heat resistance and very similar coefficient of linear expansion to ceramic, and niobium, tantalum, alloys of niobium, alloys of tantalum, cermets, etc. can be used as such a material. Since niobium, tantalum and their alloys have coefficients of linear expansion very similar to that of alumina ceramic, they can achieve particularly excellent sealing. When such a structure is to be adopted, however, since these metals do no have halogen resistance, the structure needs to be covered with the sealing glass 30 having halogen resistance. Therefore, in the structure of FIG. 6, the junction of the first electricity introducing member 24 and second electricity introducing member 27 is covered with the sealing glass 30.

A specific example of this fourth embodiment (the electric power consumption: 150 W) will be explained. The inner diameter of the wide tube 11 is 9.1 mm, the inner diameter of the narrow tubes 12 on both ends is 1.0 mm, and the length between the electrodes is 10 mm. The diameter of the electrode core 21 is 0.6 mm, the first coil 20 is formed by winding a tungsten wire with a diameter of 0.18 mm 4 to 5 turns round the electrode core 21 and its maximum diameter is 0.96 mm. For the stress buffering member 40 made of a heat-resistant metallic tube, a Nb-1% Zr alloy with an inner diameter of 0.65 mm, an outer diameter of 0.95 mm and a length of 3.0 mm is used. The electricity introducing member is constructed by the first electricity introducing member 24 made of molybdenum and the second electricity introducing member 27 made of niobium.

For the sealing glass 30, a mixture of $Al2O_3$—$SiO_2$—$Dy_2O_3$ (17 weight %-22 weight %-61 weight %) based metal oxides having the optimum composition ratio is used. The sealing glass 30 fills the gap between the electricity introducing member and the stress buffering member 40 and the gap between the stress buffering member 40 and the narrow tube 12, up to a position 4 mm from an end of the narrow tube 12. In this example, since the stress buffering member 40 is entirely covered with the sealing glass 30 having the halogen resistance, it is protected from halogen corrosion. In the arc tube 1 whose both ends are thus sealed, mercury: about 10 mg, dysprosium iodide: about 11 mg, thallium iodide: about 3 mg, sodium iodide: about 2 mg, cesium iodide: about 1 mg and an argon gas of about 8 kPa as the starting gas are enclosed.

An electric discharge lamp as shown in FIG. 2 was fabricated by incorporating the arc tube 1 thus constructed into the vacuum external tube 3 and its characteristics in lighting it in a horizontal burning position with the electric power consumption of 150 W were measured, and consequently the following were obtained. The lamp characteristics are indicated by values after 100-hour aging.

Tube electric power: 150 W

Tube current: 1.82 A

Tube voltage: 98.7 V

Total luminous flux: 13,500 lm

General color rendering index: 87

Color temperature: 4,130 K

Figure 7:
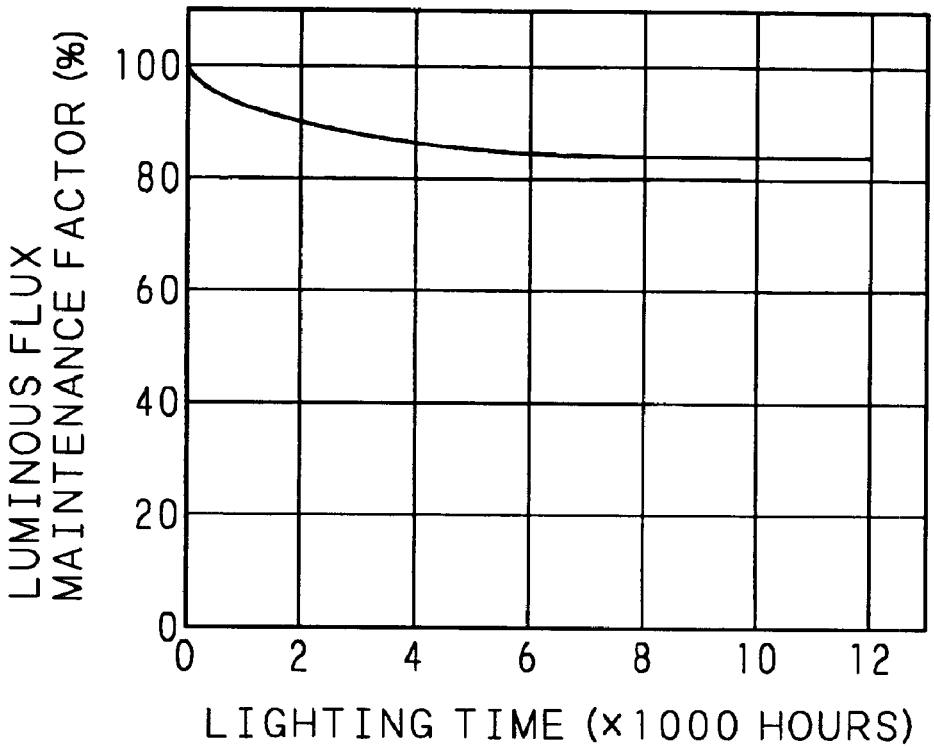
FIG. 7 is a graph showing the characteristic of the luminous flux maintenance factor of the electric discharge lamp according to the fourth embodiment.

FIG. 7 shows the results of the lamp characteristics. In FIG. 7, the vertical axis represents the luminous flux maintenance factor, while the horizontal axis is the lighting time. The electric discharge lamp of this example exhibited a luminous flux maintenance factor of not lower than 80% even after 2,000-hour lighting. In the electric discharge lamp of this example, since the stress buffering member 40 made of a heat resistant metal having a coefficient of linear expansion similar to ceramics is present between the electricity introducing member and the ceramic narrow tube 12, thermal stress generated in switching the lamp on and off is absorbed by this stress buffering member 40, and therefore the electric discharge lamp can withstand long-time lighting without causing a crack in the sealing glass 30.

Figure 1:
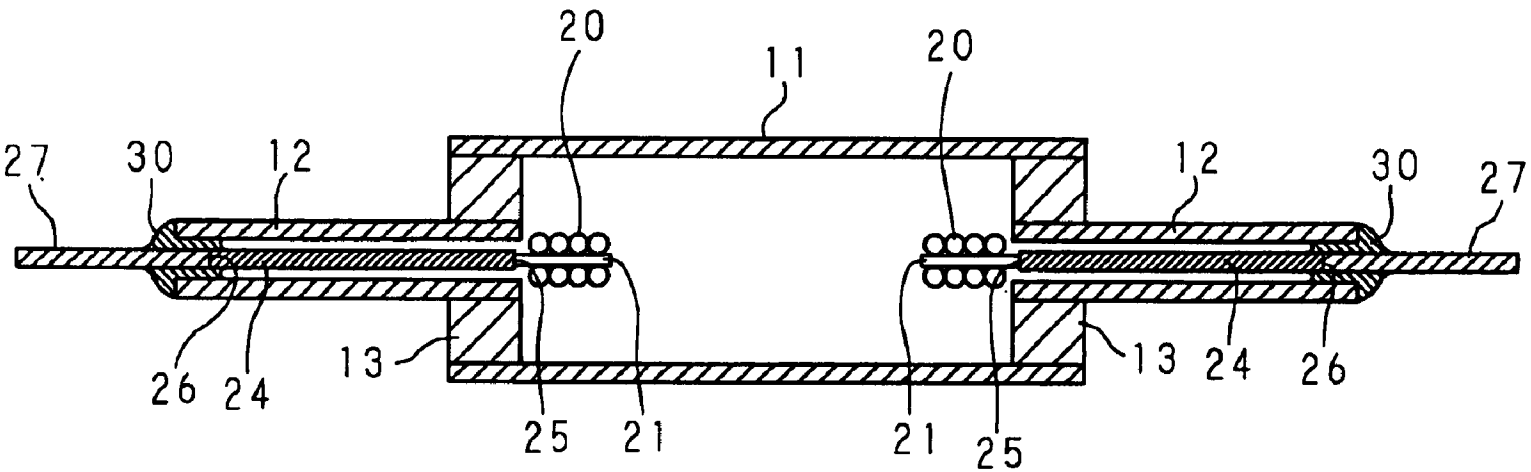
FIG. 1 PRIOR ART
FIG. 1 is a cross sectional view showing a conventional example of the sealing structure of the arc tube of an electric discharge lamp.

Besides, when the same sealing glass was used for the conventional electric discharge lamp having the structure as shown in FIG. 1, the luminous flux maintenance factor significantly lowered as the lighting time had passed about 3,000 hours, and black deposits were observed in the external tube.

(Fifth Embodiment)

Figure 8:
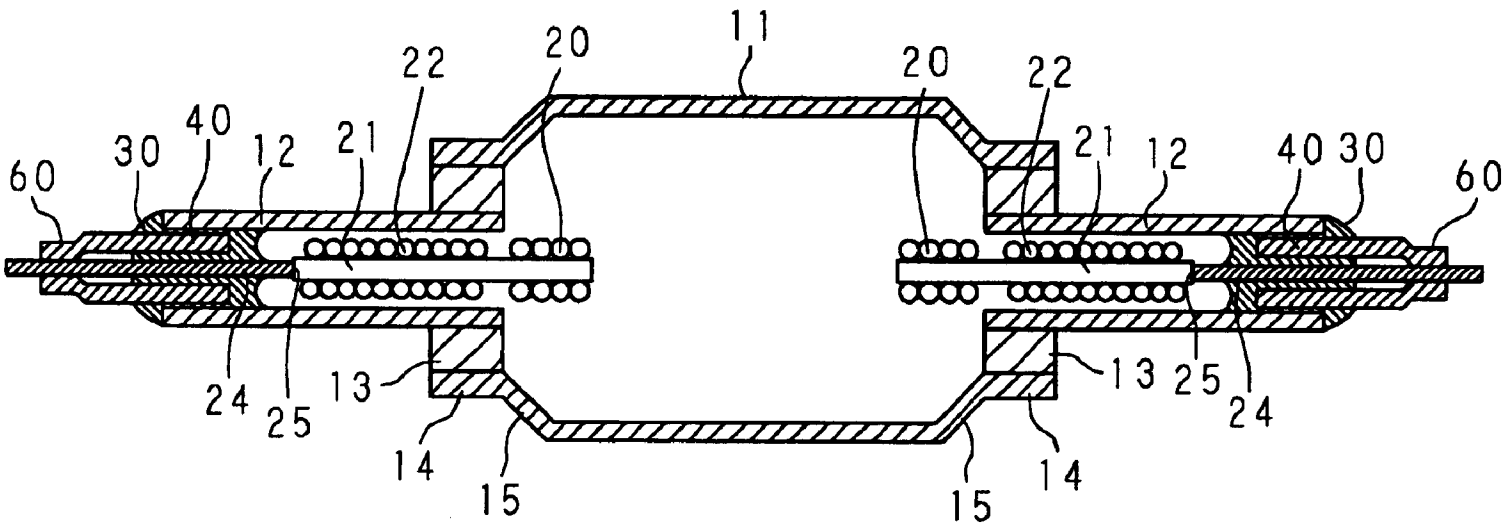
FIG. 8 is a cross sectional view showing the structure of the arc tube of an electric discharge lamp according to the fifth embodiment.

FIG. 8 is a cross sectional view showing the structure of the arc tube 1 of an electric discharge lamp according to the fifth embodiment of the present invention. In FIG. 8, the same sections as in FIG. 5 are designated with the same numbers, and the explanation thereof is omitted. The fifth embodiment is an example applied to a lamp of large electric power consumption.

Both ends of the wide tube 11 are reduced-diameter sections 14 that are narrowed down through taper sections 15. The reduced-diameter section 14 and the narrow tube 12 are airtightly joined through the disk 13. The stress buffering member 40 is mounted in a part of the region between the electricity introducing member 24 and the narrow tube 12, and the electricity introducing member 24, stress buffering member 40 and narrow tube 12 are airtightly fixed by the sealing glass 30. The stress buffering member 40 and the electricity introducing member 24 are placed in position by pressure-bonding the stress buffering member 40 at a pressure-bonding position 60.

In the structure of the above-described first or third embodiment, for the positioning of the electricity introducing member 23 or 24 and the stress buffering member 40, it is necessary to perform the process of directly electric-welding the stress buffering member 40 to the electricity introducing member 23 or 24, attaching a positioning pin to the electricity introducing member 23 or 24, or the like. In contrast, in the structure shown in FIG. 8 where the cylindrical stress buffering member 40 into which the electricity introducing member 24 is inserted is extended to the outside of the narrow tube 12, only a part of the stress buffering member 40 located in the inside of the arc tube 1 is positioned in the airtight sealed section between the electricity introducing member 24 and the narrow tube 12, and the portion of the stress buffering member 40 positioned in the arc tube 1 is covered with the sealing glass 30, there is an advantage that the stress buffering member 40 can be fixed by only mechanically pressure-bonding the stress buffering member 40 to the electricity introducing member 24.

A specific example of this fifth embodiment (the electric power consumption: 400 W) will be explained. The inner diameter of the wide tube 11 is 16 mm, the inner diameter of the narrow tubes 12 on both ends is 2.0 mm, and the length between the electrodes is 25 mm. The diameter of the electrode core 21 is 1.0 mm, the first coil 20 is formed by winding a tungsten wire with a diameter of 0.35 mm 4 to 5 turns round the electrode core 21 and its maximum diameter is 1.8 mm. For the stress buffering member 40, a Nb-1% Zr alloy as a tube body with an inner diameter of 0.6 mm, an outer diameter of 1.9 mm and a length of 9.0 mm is used. The electricity introducing member 24 is placed in position and fixed in the stress buffering member 40 by pressure-bonding the stress buffering member 40 at the pressure-bonding position 60. For the electricity introducing member 24, molybdenum which has a diameter of 0.5 mm and a length of 25 mm and contained about 0.5 weight % lanthanum oxide is used. For the sealing glass 30, a mixture of $Al_2O_3$—$SiO_2$—$Dy_2O_3$ based metal oxides having the optimum composition ratio is used. The sealing glass 30 fills the gap between the electricity introducing member 24 and the stress buffering member 40 and the gap between the stress buffering member 40 and the narrow tube 12, up to a position about 6 mm from an end of the narrow tube 12.

In this example, since about 5 mm of the stress buffering member 40 on the center side of the arc tube 1 is covered with the sealing glass 30 having the, halogen resistance, the stress buffering member 40 is protected from halogen corrosion. In the arc tube 1 whose both ends are thus sealed, mercury: about 18 mg, dysprosium iodide: about 22 mg, thallium iodide: about 6 mg, sodium iodide: about 5 mg, cesium iodide: about 3 mg and an argon gas of about 8 kPa as the starting gas are enclosed.

An electric discharge lamp as shown in FIG. 2 was fabricated by incorporating the arc tube 1 thus constructed into the vacuum external tube 3 and its characteristics in lighting it in a horizontal burning position with the electric power consumption of 400 W were measured, and consequently the following were obtained. The lamp characteristics are indicated by values after 100-hour aging.

Tube electric power: 400 W

Tube current: 3.9 A

Tube voltage: 133.2 V

Total luminous flux: 37,500 lm

General color rendering index: 87

Color temperature: 4,030 K

In addition, when a life test was executed for this electric discharge lamp by bare and horizontal burning position and the electric power consumption of 400 W, no abnormal conditions occurred even after the elapse of about 6,000 hours.

In the above first through fifth embodiments, the coefficient of linear expansion of the stress buffering member 40 is preferably between the coefficient of linear expansion of the electricity introducing member and the coefficient of linear expansion of the narrow tube 12 or is the same as the coefficient of linear expansion of the narrow tube 12, and the most preferable example is a case where the coefficients of linear expansion increase in the order of the electricity introducing member, sealing glass 30, stress buffering member 40 and narrow tube 12.

By constructing the stress buffering member 40 using a metal material having such a coefficient of linear expansion, it becomes possible to effectively absorb thermal stress, and, particularly, when the relation of the coefficients of linear expansion as in the above example is established, the thermal stress is most efficiently absorbed. Note that, as mentioned above, since the stress buffering member 40 aims for absorbing thermal stress resulting from the difference in the coefficients of linear expansion, it is preferred that the stress buffering member 40 is not directly fixed and integrated with the electricity introducing member in the airtight sealed section and a predetermined space is preferably provided therebetween. Besides, the same can also be said for the case where the coefficients of linear expansion of the narrow tube 12 and stress buffering member 40 are different. In particular, when the relation of the coefficients of linear expansion as in the above example is established, the sealing glass 30 preferably fills a space between the electricity introducing member and the stress buffering member 40.

Moreover, the stress buffering member 40 needs to be mounted at least in the airtight sealed section between the electricity introducing member and the narrow tube 12 and at least a part of the stress buffering member 40 needs to be covered with the sealing glass 30 so as to absorb thermal stress applied to the sealing glass 30, but, when a metal halide is enclosed in the arc tube 1, the stress buffering member 40 on the inner side of the arc tube 1 is preferably covered with the halogen-resistant sealing glass 30. By satisfying this, it becomes possible to use metal materials having no halogen resistance.

Besides, in the above explanation of the first through fifth embodiments, while a tube body is used as the stress buffering member 40, the stress buffering member 40 is not necessarily limited to this and may be formed by simply bending a heat-resistant metal plate into a cylindrical shape with a gap in the joint, for example. Further, it is possible that two, each having a semi-cylindrical cross section, are placed to face each other and used in a state where gaps exist at two positions. It is also possible to use one obtained by dividing a cylindrical body into a plurality parts of more than three. In other words, it is only necessary to have the stress buffering member 40 in at least a part of the region between the electricity introducing member and the narrow tube 12, and a portion where the stress buffering member 40 is not present can exist to such an extent that the function of absorbing stress is not lost.

(Sixth Embodiment)

Figure 9:
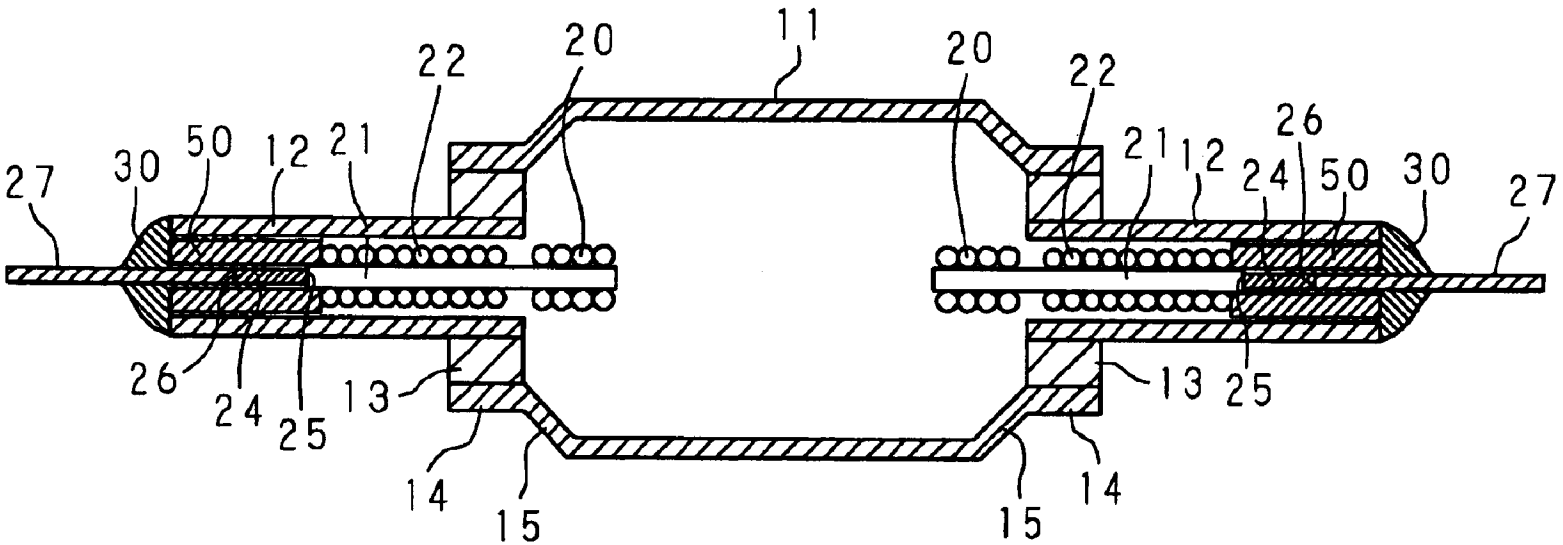
FIG. 9 is a cross sectional view showing the structure of the arc tube of an electric discharge lamp according to the sixth embodiment.

FIG. 9 is a cross sectional view showing the structure of the arc tube 1 of an electric discharge lamp according to the sixth embodiment of the present invention. In FIG. 9, the same sections as in FIGS. 6 and 8 are designated with the same numbers, and the explanation thereof is omitted. In the sixth embodiment, a ceramic sleeve 50 is used as the insertion member to be provided between the electricity introducing member and the narrow tube 12.

The electricity introducing member (the first electricity introducing member 24 and second electricity introducing member 27) to which the electrode core 21 is connected is inserted into the narrow tube 12, and the ceramic sleeve 50 is positioned round the electricity introducing member. The sealing glass 30 is pored between the ceramic sleeve 50 and the electricity introducing member and between the ceramic sleeve 50 and the narrow tube 12, so that the electricity introducing member, ceramic sleeve 50 and narrow tube 12 are airtightly fixed by the sealing glass 30. The ceramic sleeve 50 is placed in position by the second coil 22.

Since the ceramic sleeve 50 is positioned between the electricity introducing member and the narrow tube 12, if the coefficient of linear expansion thereof is not similar to the coefficient of linear expansion of the narrow tube 12, the narrow tube 12 will crack. The present inventor et al. produced trial products of five types of electric discharge lamps by forming the narrow tubes 12 from alumina ($Al_2O_3$) and constructing the ceramic sleeves 50 by alumina, titania (TiO), spinel ($MgAl_2O_4$), beryllia (BeO) and yttria ($Y_2O_3$), respectively, and found as a result of the lighting experiments that the alumina narrow tube 12 cracked only when yttria was used. The coefficients of linear expansion of the respective ceramics at 20 to 1,000° C. are alumina: $8.6\times10^{-6}$/° C., titania: $8.7\times10^{-6}$/° C., spinel: $8.8\times10^{-6}$/° C., beryllia: $8.9\times10^{-6}$/° C., and yttria: $9.3\times10^{-6}$/° C., and it is preferred to use ceramics whose coefficient of linear expansion is $8.9\times10^{-6}$/° C. or less. It is of course possible to use a mixture of such oxides or a mixture of such oxides and oxides other than these oxides as the material of the ceramic sleeve 50 if the mixing ratio is adjusted so as to satisfy a coefficient of linear expansion of $8.9\times10^{-6}$/° C. or less.

For the first electricity introducing member 24, it is preferred to use one having heat resistance and halogen resistance, more preferably having a coefficient of linear expansion which is not much different from that of the ceramic sleeve 50. The reason for this is to prevent the sealing glass 30 filling a space between the ceramic sleeve 50 and the first electricity introducing member 24 from being damaged due to covering of the junction of the first electricity introducing member 24 and second electricity introducing member 27 with the sealing glass 30, and to protect the second electricity introducing member 27 from the halogen substance. As such a material, it is possible to use molybdenum, an alloy of molybdenum, or cermet.

Besides, for the second electricity introducing member 27, it is preferred to use one having heat resistance, a coefficient of linear expansion similar to that of the ceramic forming the narrow tube 12 and further a coefficient of linear expansion similar to that of the ceramic sleeve 50. The reason for this is that it is preferable to achieve airtight fixing by the sealing glass 30 at a position of the second electricity introducing member 27 at which the ceramic sleeve 50 is mounted. Examples of such materials include niobium, tantalum, alloys of niobium and alloys of tantalum, and the coefficients of linear expansion of these materials are especially close to the coefficient of linear expansion of translucent alumina. For example, when the arc tube 1 and ceramic sleeve 50 are formed of translucent alumina and the second electricity introducing member 27 is formed of niobium, the coefficient of linear expansion of translucent alumina is $8.4\times10^{-6}$/° C. (300 to 800° C.) and the coefficient of linear expansion of niobium is $7.5\times10^{-6}$/° C. (18 to 500° C.), and the difference therebetween is within 20%. In the case of tantalum, since the coefficient of linear expansion is $6.6\times10^{-6}$/° C. (20 to 500° C.), the difference between tantalum and translucent alumina is within 25%.

By the way, in the case where the ceramic sleeve 50 is to be used, it is considered to use a long ceramic sleeve 50 without providing the second coil 22 so as to cause the ceramic sleeve 50 to perform the function of the second coil 22 (to dissipate heat at the tip of the electrode toward the rear side). In this case, however, since the ceramic has smaller heat conductivity compared to metal, it is not preferred. In the case where the second coil 22 is formed of molybdenum and the ceramic sleeve 50 is formed of alumina, since the heat conductivity of alumina (0.30 joule/cm/second/° C.) is smaller than ¼ of the heat conductivity of molybdenum (1.3 joule/cm/second/° C.), if the ceramic sleeve 50 is caused to perform the function of the second coil 22, the heat generated at the tip of the electrode is hardly transmitted toward the rear side. Therefore, a portion having a low temperature is produced in the gap on the rear side of the electrode sandwiched between the narrow tube 12 and the ceramic sleeve 50, and the temperatures of mercury and metal halide of the enclosed material staying in this low-temperature portion are not sufficiently raised. Since the temperature of the enclosed material does not increase, the vapor pressure does not increase either, and, particularly, sufficient light emission is not obtained by the metal halide, preventing realization of an electric discharge lamp having excellent efficiency and color rendering property. In addition, for the same reason, the time between the evaporation of the enclosed material after lighting the lamp and the achievement of a predetermined brightness becomes longer. Moreover, since the heat from the electrode core 21 is hardly transmitted to the narrow tube 12, the temperature of the electrode core 21 is raised. When the electrode core 21 is raised to a high temperature, the heat thereof is transmitted to the sealed section via the electricity introducing member made of metal. As a result, the temperature of the sealed section becomes higher excessively, and the lamp life is shortened. As described above, according to the structural example in which the function of the second coil 22 is performed by the ceramic sleeve 50, an electric discharge lamp having excellent characteristics can not be provided. It is therefore preferred that the insertion length of the ceramic sleeve 50 into the narrow tube 12 is not made unnecessarily long and the second coil 22 is wound round the electrode core 21 in the narrow tube 12.

A specific example of this sixth embodiment (the electric power consumption: 400 W) will be explained. The inner diameter of the wide tube 11 is 16 mm, the inner diameter of the narrow tubes 12 on both ends is 2.0 mm, and the length between the electrodes is 27 mm. The electrode core 21 is made of tungsten with a diameter of 0.9 mm, the first coil 20 is formed by winding a tungsten wire with a diameter of 0.35 mm 4 to 5 turns round the electrode core 21 and its maximum diameter is 1.6 mm. For the second coil 22, a molybdenum wire with a diameter of 0.45 mm is wound 26 to 28 turns. The first electricity introducing member 24 is formed by molybdenum with a diameter of 0.5 mm and a length of 3 mm, and butt-welded to the electrode core 21 at the welding position 25. The second electricity introducing member 27 is formed by niobium with a diameter of 0.7 mm and butt-welded to the first electricity introducing member 24 at the welding position 26.

The ceramic sleeve 50 is formed of alumina, and has an inner diameter of 0.75 mm, an outer diameter of 1.9 mm and a length of 6 mm. The second electricity introducing member 27 is inserted into the narrow tube 12 by about 3 mm, and fixed at this position by the sealing glass 30. For the sealing glass 30, a mixture of $Al_2O_3$—$SiO_2$—$Dy_2O_3$ based metal oxides having the optimum composition ratio is used. The sealing glass 30 fills the gap between the electricity introducing member and the ceramic sleeve 50 and the gap between the ceramic sleeve 50 and the narrow tube 12, up to a position about 6 mm from an end of the narrow tube 12. In other words, since the junction of the first electricity introducing member 24 and second electricity introducing member 27 constituting the electricity introducing member is covered with the sealing glass 30, the second electricity introducing member 27 is protected from halogen corrosion.

In this example, the layer thickness of the sealing glass 30 is the gap between the narrow tube 12 and the ceramic sleeve 50 and also the gap between the ceramic sleeve 50 and the electricity introducing member, and each layer thickness is 0.2 mm or less. If the layer thickness of the sealing glass 30 is 0.2 mm or less, it achieves excellent heat resistance and thermal shock resistance as the sealing structure.

In the arc tube 1 whose both ends are thus sealed, mercury: about 15 mg, dysprosium iodide: about 22 mg, thallium iodide: about 8 mg, sodium iodide: about 3 mg, cesium iodide: about 2 mg and an argon gas of about 8 kPa as the starting gas are enclosed.

An electric discharge lamp as shown in FIG. 2 was fabricated by incorporating the arc tube 1 thus constructed into the vacuum external tube 3 and its characteristics in lighting it in a horizontal burning position with the electric power consumption of 400 W were measured, and consequently the following were obtained. The lamp characteristics are indicated by values after 100-hour aging.

Tube electric power: 400 W

Tube current: 3.85 A

Tube voltage: 118.7 V

Total luminous flux: 39,000 lm

General color rendering index: 87

Color temperature: 4,130 K

In addition, when a life test was executed for this electric discharge lamp by bare and horizontal burning position and the electric power consumption of 400 W, no abnormal conditions occurred even after the elapse of about 6,000 hours.

(Seventh Embodiment)

Figure 10:
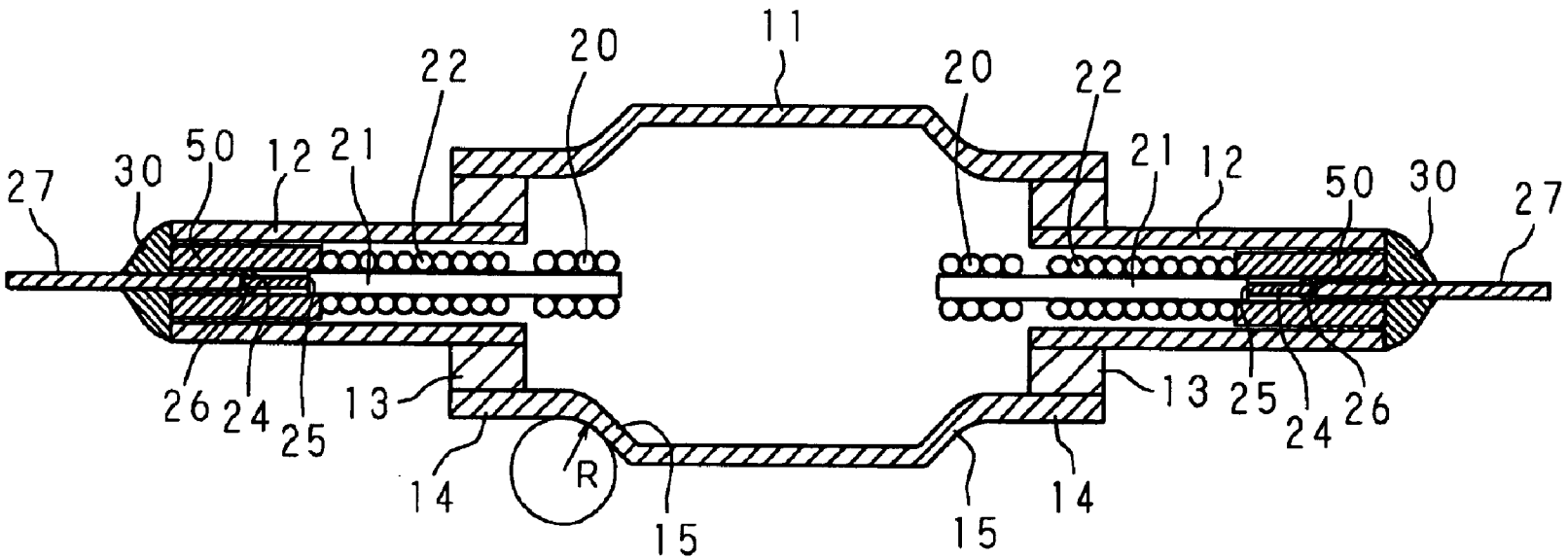
FIG. 10 is a cross sectional view showing the structure of the arc tube of an electric discharge lamp according to the seventh embodiment.

FIG. 10 is a cross sectional view showing the structure of the arc tube 1 of an electric discharge lamp according to the seventh embodiment of the present invention. In FIG. 10, the same sections as in FIG. 9 are designated with the same numbers, and the explanation thereof is omitted.

The arc tube 1 formed of a translucent alumina tube is composed of the wide tube 11 at the center and the narrow tubes 12 mounted to both ends thereof. Both ends of the wide tube 11 have reduced-diameter sections 14 which are narrowed down through the taper sections 15 having curved surfaces with a radius of curvature R of 2 mm or more. The reduced-diameter section 14 and the narrow tube 12 are airtightly joined with the alumina disk 13, and the reduced-diameter section 14 has a linear section between its portion to which the disk 13 is mounted and the taper section 15.

Regarding the arc tube 1 having such a structure, the arc tube 1 which cracked during the sealing process were investigated, and it was found that all the cracks occurred between the narrow tube 12 and the ceramic sleeve 50. The present inventor et al. considered that the cracks were caused by the influence of the dimensions of the respective parts in the sealed section due to the difference in the coefficients of linear expansion between the sealing glass 30 and the ceramic sleeve 50. Therefore, trial products of a plurality of types of electric discharge lamps were produced by changing the inner diameter of the narrow tube 12 and the outer diameter of the ceramic sleeve 50.

The inner diameter of the wide tube 11 was 16 mm, the inner diameter of the reduced-diameter section 14 was 10 mm, the radius of curvature R of the taper section 15 was 5 mm, and the inner diameter of the narrow tube 12 was changed to 2 mm and 3 mm. These wide tube 11, narrow tube 12, reduced-diameter section 14 and taper section were made of translucent alumina. The electrode core 21 is made of tungsten with a diameter of 0.9 mm, and the first coil 20 (tungsten) and the second coil 22 (molybdenum) are wound round the electrode core 21. The first electricity introducing member 24 is formed from molybdenum with a diameter of 0.5 mm and a length of 3 mm, and butt-welded to the electrode core 21 at the welding position 25. The second electricity introducing member 27 is formed from niobium with a diameter of 0.7 mm and butt-welded to the first electricity introducing member 24 at the welding position 26.

For the ceramic sleeve 50, one formed from the same alumina as used for the material of the arc tube 1 with a length of 6 mm, an inner diameter of 0.75 mm and a changed outer diameter was used. The second electricity introducing member 27 is inserted into the narrow tube 12 by about 3 mm, and fixed at this position by the sealing glass 30. For the sealing glass 30, a mixture of $Al_2O_3$—$SiO_2$—$Dy_2O_3$ based metal oxides having the optimum composition ratio was used. The sealing glass 30 fills the gap between the electricity introducing member and the ceramic sleeve 50 and the gap between the ceramic sleeve 50 and the narrow tube 12, up to a position about 6 mm from an end of the narrow tube 12.

Table 1 below shows the rate of occurrence of crack for the electric discharge lamps thus produced as trial products by changing the inner diameter of the narrow tube 12 and the outer diameter of the ceramic sleeve 50. It is apparent from Table 1 that, when the difference between the inner diameter (A) of the narrow tube 12 and the outer diameter (B) of the ceramic sleeve 50 exceeds 0.6 mm, the rate of occurrence of crack abruptly increases. Besides, the lower limit of the difference is preferably 0.02 mm that is the minimum dimension the sealing glass 30 can flow.

TABLE 1

| Inner Diameter of Narrow Tube A (mm) | Outer Diameter Of Ceramic Sleeve B (mm) | A/B | A–B (mm) | Rate Of Occurrence Of Crack (%) |
|---|---|---|---|---|
| 2 | 1.98 | 1.01 | 0.02 | 0 |
| | 1.95 | 1.03 | 0.05 | 0 |
| | 1.8 | 1.11 | 0.2 | 0 |
| | 1.7 | 1.18 | 0.3 | 0 |
| | 1.6 | 1.25 | 0.4 | 0 |
| | 1.5 | 1.33 | 0.5 | 0 |
| | 1.4 | 1.43 | 0.6 | 0 |
| | 1.3 | 1.54 | 0.7 | 60 |
| | 1.2 | 1.67 | 0.8 | 60 |
| | 1.1 | 1.82 | 0.9 | 100 |
| | 1 | 2 | 1 | 100 |
| 3 | 2.98 | 1.01 | 0.02 | 0 |
| | 2.9 | 1.03 | 0.1 | 0 |
| | 2.8 | 1.07 | 0.2 | 0 |
| | 2.7 | 1.11 | 0.3 | 0 |
| | 2.6 | 1.15 | 0.4 | 0 |
| | 2.5 | 1.2 | 0.5 | 0 |
| | 2.4 | 1.25 | 0.6 | 0 |
| | 2.3 | 1.3 | 0.7 | 40 |
| | 2.2 | 1.36 | 0.8 | 80 |
| | 2.1 | 1.43 | 0.9 | 100 |
| | 2 | 1.5 | 1 | 100 |

As described above, by making the difference between the inner diameter of the narrow tube 12 and the outer diameter of the ceramic sleeve 50 within a range of 0.02 to 0.6 mm, it is possible to manufacture an excellent arc tube 1 without causing a crack during the sealing process.

An electric discharge lamp as shown in FIG. 2 was fabricated by incorporating the arc tube 1 constructed by making the difference between the inner diameter of the narrow tube 12 and the outer diameter of the ceramic sleeve 50 within the range of 0.02 to 0.6 mm into the vacuum external tube 3, and a lighting test was executed. A life test was carried out up to 9,000 hours, but no defects such as cracks did not occur and an excellent life characteristic was obtained.

(Eighth Embodiment)

Figure 11:
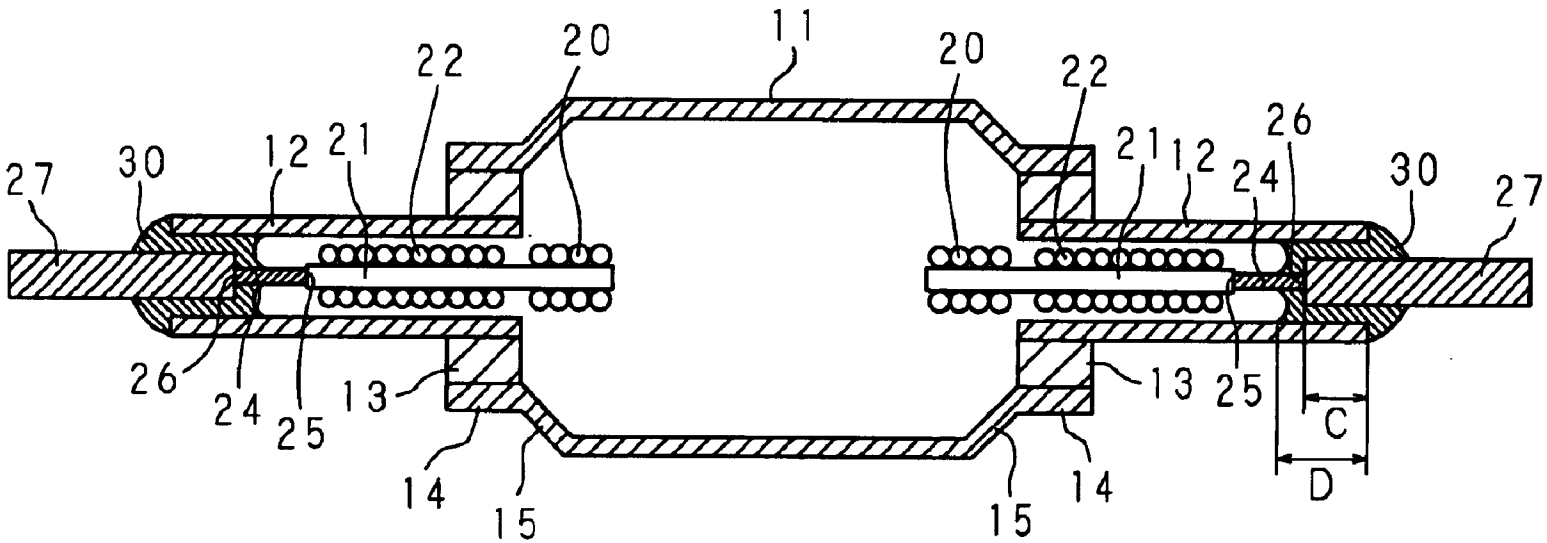
FIG. 11 is a cross sectional view showing the structure of the arc tube of an electric discharge lamp according to the eighth embodiment.

FIG. 11 is a cross sectional view showing the structure of the arc tube 1 of an electric discharge lamp according to the eighth embodiment of the present invention. In FIG. 11, the same sections as in FIG. 9 are designated with the same numbers, and the explanation thereof is omitted.

In the narrow tube 12, the first electricity introducing member 24 butt-welded to the electrode core 21 at the welding position 25 and the second electricity introducing member 27 butt-welded to the first electricity introducing member 24 at the welding position 26 are airtightly fixed by the sealing glass 30.

In the eighth embodiment, the relation D–C≧1.0 mm is satisfied between the insertion length (C) of the second electricity introducing member 27 into the narrow tube 12 and the flow-in length (D) of the sealing glass 30 into the narrow tube 12. When this relation is satisfied, the life of the lamp can be made longer. When this relation is not satisfied, a halide as the enclosed material advances along the boundary between the sealing glass 30 and the first electricity introducing member 24, and the second electricity introducing member 27 chemically reacts with halogen and is corroded. As a result, electrical connection is eventually lost at the welding section 26 between the first electricity introducing member 24 and the second electricity introducing member 27, and the lamp can not be lit.

The following description will explain experiments about the above-mentioned relation between C and D performed by the present inventor et al. A plurality of trial products of electric discharge lamp were produced by changing the length (D–C), and the respective lamp characteristics (the luminous flux maintenance factors when the lighting time was 3,000 hours) were measured. The results are shown in Table 2 below.

TABLE 2

| D–C (mm) | Lighting Time (Hour) | Luminous Flux Maintenance Factor (%) |
|---|---|---|
| 0 | 3,000 | 35 |
| 0.5 | 3,000 | 68 |
| 1.0 | 3,000 | 93 |
| 1.5 | 3,000 | 92 |
| 2.0 | 3,000 | 94 |

When the lengths (D–C) were 0 mm and 0.5 mm, the luminous flux maintenance factors during the lighting time of 3,000 hours were 35% and 68%, respectively. On the other hand, when the length (D–C) was 1.0 mm or more, each electric discharge lamp maintained a luminous flux maintenance factor of 90% or more. Additionally, in the former case, the entire appearance of the arc tube 1 was blackened, while, in the latter case, the arc tube 1 was not blackened and was clean. In the former case, it is considered that a metal halide as the enclosed material came into contact with the second electricity introducing member 27 made of niobium and caused a chemical reaction, the reactant deposited on the entire inner face of the arc tube 1, and the arc tube 1 was blackened. Moreover, it was confirmed through further experiments performed by the present inventor et al. that electric discharge lamps with the length (D–C) of 1.0 mm or more retained the luminous flux maintenance factors of 70% or more even when the lighting time was extended to 6,000 hours. Therefore, when a luminous flux maintenance factor of 90% or more for the lighting time of 3,000 hours and a luminous flux maintenance factor of 70% or more for the lighting time of 6,000 hours are set as the thresholds, the length (D–C) needs to be made 1.0 mm or more.

Further, when the sealing glass 30 overflows the tip of the first electricity introducing member 24, since the volume of the sealing glass 30 flowing in the space surrounded by the inner wall of the narrow tube 12 and the first electricity introducing member 24 increases and the electrode and the sealing glass 30 come into contact with each other, the sealing glass 30 will crack at this portion. Subsequently, the narrow tube 12 will crack and a leakage of airtightness will occur in the arc tube 1, and consequently the electric discharge lamp can not be lit.

(Ninth Embodiment)

Figure 12:
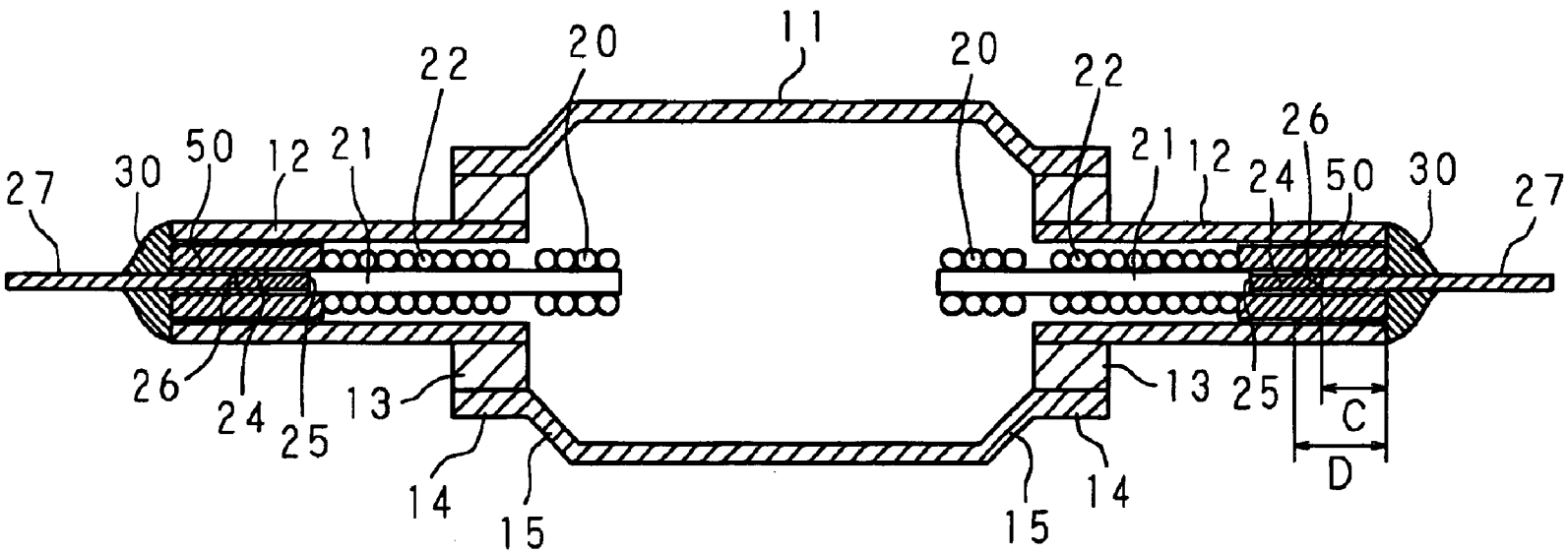
FIG. 12 is a cross sectional view showing the structure of the arc tube of an electric discharge lamp according to the ninth embodiment.

FIG. 12 is a cross sectional view showing the structure of the arc tube 1 of an electric discharge lamp according to the ninth embodiment of the present invention. In FIG. 12, the same sections as in FIG. 9 are designated with the same numbers, and the explanation thereof is omitted.

In the narrow tube 12, the first electricity introducing member 24 butt-welded to the electrode core 21 at the welding position 25, the second electricity introducing member 27 butt-welded to the first electricity introducing member 24 at the welding position 26 and the ceramic sleeve 50 arranged between the first and second electricity introducing members 24, 27 and the narrow tube 12 are airtightly fixed by the sealing glass 30.

In this ninth embodiment, for the same reason as in the eighth embodiment, the relation D–C≧1.0 mm is satisfied between the insertion length C of the second electricity introducing member 27 into the narrow tube 12 and the flow-in length D of the sealing glass 30 into the narrow tube 12.

A specific example of this ninth embodiment (the electric power consumption: 400 W) will be explained. The wide tube 11 is formed from alumina and has an inner diameter of 16 mm, the narrow tube 12 is formed from alumina and has an inner diameter of 2.0 mm, and the length between the electrodes is 23 mm. The electrode core 21 has a diameter of 0.9 mm, the first coil 20 is formed by winding a tungsten wire with a diameter of 0.35 mm 4 to 5 turns round the electrode core 21 and its maximum diameter is 1.6 mm.

The first electricity introducing member 24 is formed from molybdenum with a diameter of 0.5 mm and a length of 3 mm, and butt-welded to the electrode core 21 at the welding position 25. The second electricity introducing member 27 is formed from niobium with a diameter of 0.7 mm and butt-welded to the first electricity introducing member 24 at the welding position 26. The ceramic sleeve 50 is formed from alumina, and has an inner diameter of 0.75 mm, an outer diameter of 1.9 mm and a length of 6 mm. The second electricity introducing member 27 is inserted into the narrow tube 12 by about 3 mm, and fixed at this position by the sealing glass 30.

For the sealing glass 30,a mixture of $Al_2O_3$—$SiO_2$—$Dy_2O_3$ based metal oxides having the optimum composition ratio is used. The sealing glass 30 fills the gap between the electricity introducing member and the ceramic sleeve 50 and the gap between the ceramic sleeve 50 and the narrow tube 12, up to a position about 5 mm from an end of the narrow tube 12. In this example, the relation between the insertion length C of the second electricity introducing member 27 into the narrow tube 12 and the flow-in length D of the sealing glass 30 into the narrow tube 12 is D−C=2.0 mm, and satisfies the relation D−C≧1.0 mm.

In the arc tube 1 whose both ends are thus sealed, mercury: about 22 mg, dysprosium iodide: about 22 mg, thallium iodide: about 8 mg, sodium iodide: about 3 mg, cesium iodide: about 2 mg and an argon gas of about 8 kPa as the starting gas are enclosed. An electric discharge lamp as shown in FIG. 2 was fabricated by incorporating the arc tube 1 thus constructed into the vacuum external tube 3 and its characteristics in lighting it in a horizontal burning position with the electric power consumption of 400 W were measured, and consequently the following were obtained.

Tube electric power: 400 W

Tube current: 4.06 A

Tube voltage: 110.1 V

Total luminous flux: 39,400 lm

General color rendering index: 86

Color temperature: 5,100 K

Besides, when a life test was executed for this electric discharge lamp by bare and horizontal burning position and the electric power consumption of 400 W, no abnormal conditions occurred even after the elapse of about 9,000 hours.

(Tenth Embodiment)

Figure 13:
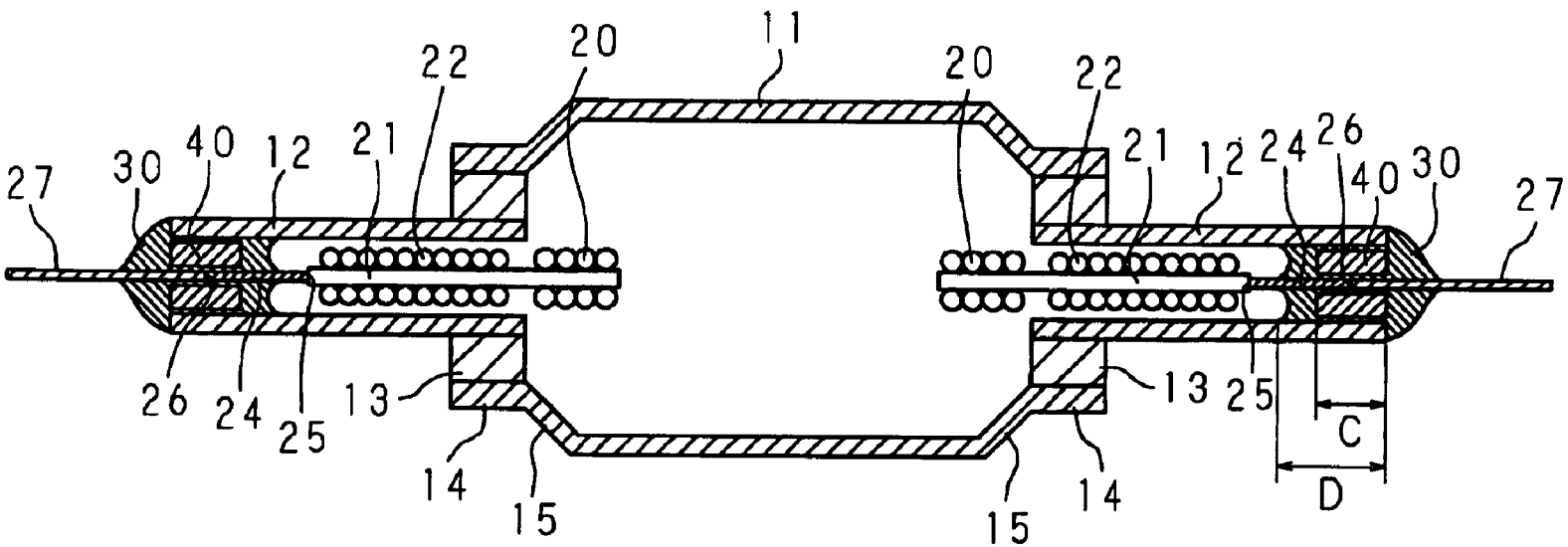
FIG. 13 is a cross sectional view showing the structure of the arc tube of an electric discharge lamp according to the tenth embodiment.

FIG. 13 is a cross sectional view showing the structure of the arc tube 1 of an electric discharge lamp according to the tenth embodiment of the present invention. In FIG. 13, the same sections as in FIGS. 6 and 12 are designated with the same numbers, and the explanation thereof is omitted.

In the narrow tube 12, the first electricity introducing member 24 butt-welded to the electrode core 21 at the welding position 25, the second electricity introducing member 27 butt-welded to the first electricity introducing member 24 at the welding position 26 and the heat-resistant metallic stress buffering member 40, which are formed from niobium, for example, and arranged between the first and second electricity introducing members 24, 27 and the narrow tube 12, are airtightly fixed by the sealing glass 30. As the stress buffering member 40, one in the shape of tube is inserted between the first and second electricity introducing members 24, 27 and the narrow tube 12. Like the fourth embodiment, the stress buffering member 40 absorbs thermal stress generated by the difference in the coefficients of linear expansion among four different materials of the first and second electricity introducing members 24, 27, the sealing glass 30

In this ninth embodiment, for the same reason as in the eighth embodiment, the relation D−C≧1.0 mm is also satisfied between the insertion length C of the second electricity introducing member 27 into the narrow tube 12 and the flow-in length D of the sealing glass 30 into the narrow tube 12.

A specific example of this tenth embodiment (the electric power consumption: 250 W) will be explained. The wide tube 11 has an inner diameter of 13 mm, the narrow tube 12 has an inner diameter of 1.5 mm, and the length between the electrodes is 18 mm. The electrode core 21 has a diameter of 0.7 mm, the first coil 20 is formed by winding a tungsten wire with a diameter of 0.30 mm 4 to 5 turns round the electrode core 21 and its maximum diameter is 1.30 mm. For the stress buffering member 40, a Nb-1% Zr alloy with an inner diameter of 0.75 mm, an outer diameter of 1.4 mm and a length of 3.0 mm is used. The second electricity introducing member 27 is made of a Nb-1% Zr alloy with a diameter of 0.7 mm and a length of about 20 mm, and is inserted into the narrow tube 12 by about 3 mm and fixed at this position by the sealing glass 30. For the sealing glass 30, a mixture of $Al_2O_3$—$SiO_2$—$Dy_2O_3$ based metal oxides having the optimum composition ratio was used. The sealing glass 30 fills the gap between the electricity introducing member and the stress buffering member 40 and the gap between the stress buffering member 40 and the narrow tube 12, up to a position about 5 mm from an end of the narrow tube 12.

In this example, the relation between the insertion length C of the second electricity introducing member 27 into the narrow tube 12 and the flow-in length D of the sealing glass 30 into the narrow tube 12 is D−C=2.0 mm, and satisfies the relation D−C≧1.0 mm.

Furthermore, since the stress buffering member 40 is entirely covered with the sealing glass 30 having halogen resistance, it is protected from halogen corrosion. In the arc tube 1 whose both ends are thus sealed, mercury: about 15 mg, dysprosium iodide: about 20 mg, thallium iodide: about 6 mg, sodium iodide: about 4 mg, cesium iodide: about 4 mg and an argon gas of about 8 kPa as the starting gas are enclosed. An electric discharge lamp as shown in FIG. 2 was fabricated by incorporating the arc tube 1 thus constructed into the vacuum external tube 3 and its characteristics in lighting it in a horizontal burning position with the electric power consumption of 250 W were measured, and consequently the following were obtained.

Tube electric power: 250 W

Tube current: 2.41 A

Tube voltage: 123.9 V

Total luminous flux: 22,500 lm

General color rendering index: 86

Color temperature: 4,230 K

Besides, when a life test was executed for this electric discharge lamp by bare and horizontal burning position and the electric power consumption of 250 W, no abnormal conditions occurred even after the elapse of about 9,000 hours.

(Eleventh Embodiment)

Figure 14:
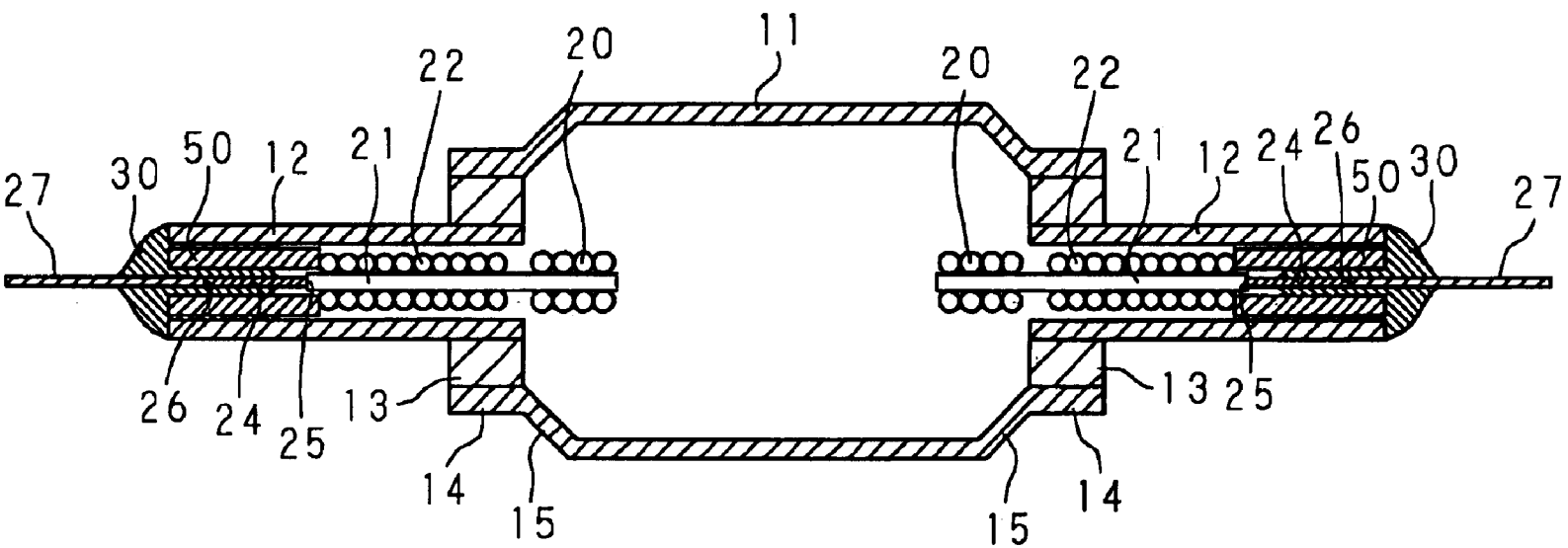
FIG. 14 is a cross sectional view showing the structure of the arc tube of an electric discharge lamp according to the eleventh embodiment.

FIG. 14 is a cross sectional view showing the structure of the arc tube 1 of an electric discharge lamp according to the eleventh embodiment of the present invention. In FIG. 14, the same sections as in FIG. 12 are designated with the same numbers, and the explanation thereof is omitted.

In this eleventh embodiment, the diameter of the first electricity introducing member 24 formed from molybdenum or molybdenum alloy having halogen resistance is not less than 0.3 mm but not more than 0.7 mm. The diameter of the first electricity introducing member 24 is made 0.7 mm or less for the reasons that, when the diameter is more than 0.7 mm, even if the thickness of the ceramic sleeve 50, the inner diameter of the narrow tube 12, the diameter of the second electricity introducing member 27, etc. are adjusted, it is difficult to prevent the narrow tube 12 from cracking during sealing and prevent occurrence of a leakage of airtightness from the sealing glass 30 at an early stage due to the heat cycle by switching the lamp on and off, but, when the diameter is made 0.7 mm or less, it becomes possible to easily prevent the narrow tube 12 from cracking during sealing and prevent occurrence of a leakage of airtightness from the sealing glass 30 at an early stage due to the heat cycle by switching the lamp on and off by suitably adjusting other structures.

For example, when the $Al_2O_3$—$SiO_2$—$Dy_2O_3$ based sealing glass 30 is used and the size of the respective sections are determined so that the layer thickness of the sealing glass 30 formed between the narrow tube 12 and the ceramic sleeve 50 and between the ceramic sleeve 50 and the electricity introducing member is 0.2 mm or less, it is possible to prevent the narrow tube 12 from cracking during sealing and prevent occurrence of a leakage of airtightness from the sealing glass 30 at an early stage due to the heat cycle by switching the lamp on and off. Furthermore, among the mixtures of $Al_2O_3$—$SiO_2$—$Dy_2O_3$ based metal oxides, when one having the optimum composition ratio is used, it is possible to more certainly exhibit this effect.

The following description will explain experiments about the diameter of the first electricity introducing member 24 performed by the present inventor et al. A plurality of trial sealing structures were produced by changing the diameter of the first electricity introducing member 24 made of molybdenum, and the airtightness at the sealed section in each sealing structure was examined. The results are shown in Table 3 below.

TABLE 3

| Diameter Of First Electricity Introducing Member (mm) | Airtightness At Sealed Section |
|---|---|
| 0.3 | Presence |
| 0.4 | Presence |
| 0.5 | Presence |
| 0.6 | Presence |
| 0.7 | Presence |
| 0.8 | Absence |

It is apparent from the results of Table 3 that excellent airtightness can be realized by making the diameter of the first electricity introducing member 24 made of molybdenum 0.7 mm or less. When the diameter is 0.8 mm or more, the sealing glass 30 will crack and the airtightness will be lost due to the difference in the coefficients of linear expansion between the sealing glass 30 and the first electricity introducing member 24.

Besides, from the view point of the airtightness at the sealed section, the diameter of the first electricity introducing member 24 is preferably small, but if it is too small, the first electricity introducing member 24 can not withstand mechanical shock applied during the fabrication process of a lamp. In addition, if the diameter is too small, after the fabrication of the lamp, the first electricity introducing member 24 is heated by a current in lighting the lamp, and portions having uneven temperatures will be locally produced, resulting in a crack in the sealing glass 30. Accordingly, the diameter of the first electricity introducing member 24 is preferably 0.3 mm or more.

Further, as the material of the first electricity introducing member 24, it is also possible to use cermets. There are three conditions for usable cermets that the cermets have electrical conductivity, halogen resistance and coefficients of linear expansion similar to the coefficient of linear expansion of alumina (the narrow tube 12). As cermets satisfying these conditions, specifically, chrome-alumina, molybdenum-alumina, tungsten-alumina, etc. can be used.

A specific example of this eleventh embodiment (the electric power consumption: 400 W) will be explained. The wide tube 11 has an inner diameter of 16 mm, the narrow tube 12 has an inner diameter of 2.0 mm, and the length between the electrodes is 27 mm. The electrode core 21 is a tungsten wire with a diameter of 0.9 mm, and the first coil 20 is formed by winding a tungsten wire with a diameter of 0.35 mm 4 to 5 turns round the electrode core 21 and its maximum diameter is 1.6 mm. The second coil 22 is formed by winding a molybdenum wire with a diameter of 0.45 mm 26 to 28 turns.

The first electricity introducing member 24 is molybdenum with a diameter of 0.7 mm and a length of 3 mm, and butt-welded to the electrode core 21 at the welding position 25. The second electricity introducing member 27 is niobium with a diameter of 0.7 mm and butt-welded to the first electricity introducing member 24 at the welding position 26. The ceramic sleeve 50 is formed from the same translucent alumina used for the arc tube 1, and has an inner diameter of 0.75 mm, an outer diameter of 1.9 mm and a length of 6 mm.

The second electricity introducing member 27 is inserted into the narrow tube 12 by about 3 mm, and fixed at this position by the sealing glass 30. For the sealing glass 30, a mixture of $Al_2O_3$—$SiO_2$—$Dy_2O_3$ (16.8 weight %-21.8 weight %-61.4 weight %) based metal oxides having the optimum composition ratio is used. The sealing glass 30 fills the gap between the electricity introducing member and the ceramic sleeve 50 and the gap between the ceramic sleeve 50 and the narrow tube 12, up to a position about 5 mm from an end of the narrow tube 12. In other words, since the junction of the first electricity introducing member 24 and second electricity introducing member 27 is covered with the sealing glass 30, the second electricity introducing member 27 is protected from halogen corrosion.

In this example, the layer thickness of the sealing glass 30 is the gap between the narrow tube 12 and the ceramic sleeve 50 and the gap between the ceramic sleeve 50 and the electricity introducing member, and each layer thickness is 0.2 mm or less. If the layer thickness of the sealing glass 30 is 0.2 mm or less, it achieves excellent heat resistance and thermal shock resistance as the sealing structure.

In the arc tube 1 whose both ends are thus sealed, mercury: about 15 mg, dysprosium iodide: about 22 mg, thallium iodide: about 8 mg, sodium iodide: about 3 mg, cesium iodide: about 2 mg and an argon gas of about 10 kPa as the starting gas are enclosed.

An electric discharge lamp as shown in FIG. 2 was fabricated by incorporating the arc tube 1 thus constructed into the vacuum external tube 3 and its characteristics in lighting it in a horizontal burning position with the electric power consumption of 400 W were measured, and consequently the following were obtained.

The characteristics are indicated by values after 100-hour aging.

Tube electric power: 400 W

Tube current: 3.87 A

Tube voltage: 116 V

Total luminous flux: 37,800 lm

General color rendering index: 87

Color temperature: 3,980 K

Besides, when a life test was executed for this electric discharge lamp by repeatedly switching on the lamp for 5.5 hours and switching off the lamp for 0.5 hour by bare and horizontal burning position and the electric power consumption of 400 W, no abnormal conditions occurred even after the elapse of about 6,000 hours.

(Twelfth Embodiment)

Figure 15:
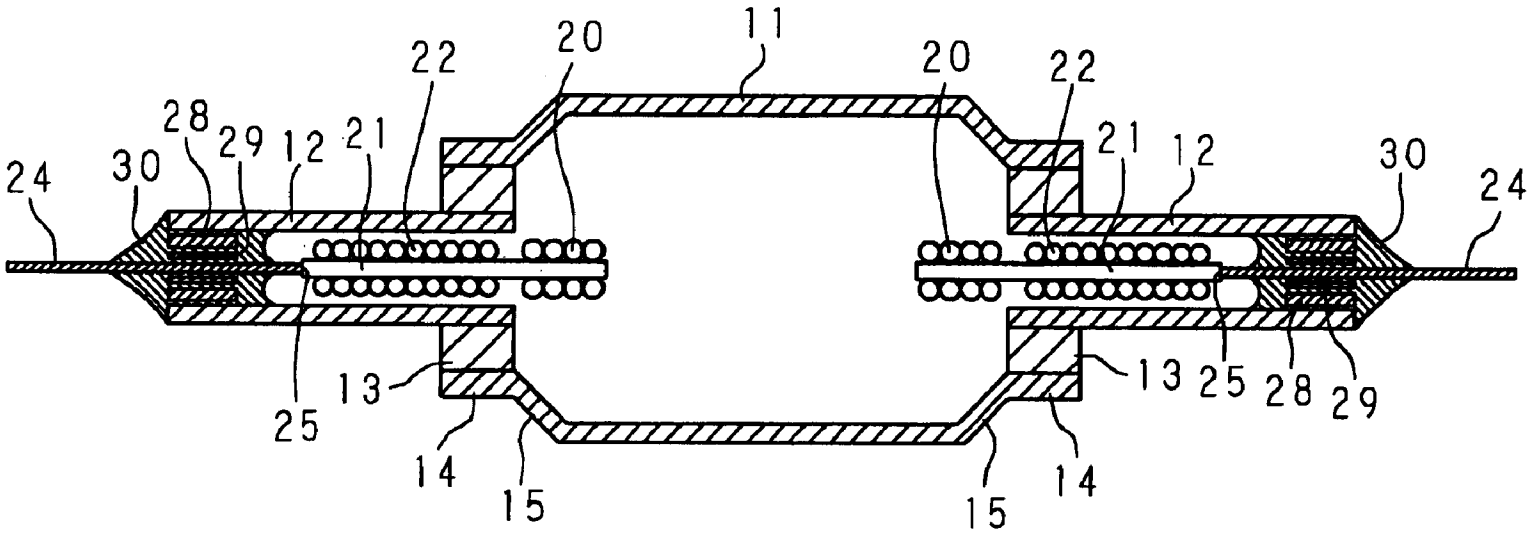
FIG. 15 is a cross sectional view showing the structure of the arc tube of an electric discharge lamp according to the twelfth embodiment.

FIG. 15 is a cross sectional view showing the structure of the arc tube 1 of an electric discharge lamp according to the twelfth embodiment of the present invention. In FIG. 15, the same sections as in FIG. 5 are designated with the same numbers, and the explanation thereof is omitted.

In this twelfth embodiment, as the insertion member, a layered product composed of a ceramic sleeve and a heat-resistant metal layer is used. More specifically, in the outer end portion of the narrow tube 12, the electricity introducing member 24 butt-welded to the electrode core 21 at the welding section 25 and a layered product composed of a ceramic sleeve 28 and a heat-resistant metal layer 29, arranged between the electricity introducing member 24 and the narrow tube 12, are airtightly fixed by the sealing glass 30.

For the ceramic sleeve 28, the same ceramic as that used for forming the arc tube 1 or one having similar coefficient of linear expansion is used. Therefore, the sealed section is further reinforced. Note that the similar coefficient of linear expansion means that the difference from the coefficient of linear expansion of the ceramic forming the arc tube 1 is within 25%, and the closer the coefficient of linear expansion, the better the result obtained. Moreover, for the heat-resistant metal layer 29, niobium, an alloy of niobium, tantalum, or an alloy of tantalum is used. The coefficients of linear expansion of these metals are very close to that of ceramics and they are soft metals that can be readily deformed, and therefore they are suitable for the stress buffering member for absorbing thermal stress generated between different kinds of materials and the sealed section is further reinforced.

In such a structure, since the electricity introducing member 24 and the narrow tube 12 are airtightly fixed through the ceramic sleeve 28 and the heat-resistant metal layer 29, even if this structure is applied to an electric discharge lamp having the narrow tube 12 of a large inner diameter and large electric power consumption, the layer thickness of the sealing glass 30 formed between the electricity introducing member 24 and the narrow tube 12 does not increase, thereby preventing the narrow tube 12 from cracking during sealing and preventing a leakage of airtightness from the sealing glass 30 at an early stage due to the heat cycle by switching the lamp on and off.

A specific example of this twelfth embodiment (the electric power consumption: 700 W) will be explained. The wide tube 11 has an inner diameter of 18 mm, the narrow tube 12 has an inner diameter of 3.5 mm, and the length between the electrodes is 30 mm. The electrode core 21 has a diameter of 1.2 mm, and the first coil 20 is formed by winding a tungsten wire with a diameter of 1.0 mm 4 to 5 turns round the electrode core 21 and its maximum diameter is 3.2 mm. The electricity introducing member 24 is formed from molybdenum with a diameter of 0.7 mm and a length of 20 mm, and butt-welded to the electrode core 21 at the welding position 25.

The ceramic sleeve 28 is formed from alumina, and has an inner diameter of 1.4 mm, an outer diameter of 3.4 mm and a length of 3 mm. The heat-resistant metal layer 29 is formed from niobium, and has an inner diameter of 0.75 mm, an outer diameter of 1.35 mm and a length of 3 mm. The ceramic sleeve 28 and heat-resistant metal layer 29 are inserted into the narrow tube 12 from an end face of the narrow tube 12 by about 3 mm and fastened with a pin. The electricity introducing member 24, and the ceramic sleeve 28 and heat-resistant metal layer 29 are airtightly fixed by the sealing glass 30, respectively.

For the sealing glass 30, a mixture of $Al_2O_3$—$SiO_2$—$Dy_2O_3$ based metal oxides having the optimum composition ratio is used. The sealing glass 30 fills the gap between the electricity introducing member 24 and the heat-resistant layer 29, the gap between the heat-resistant layer 29 and the ceramic sleeve 28, and the gap between the ceramic sleeve 28 and the narrow tube 12, up to a position 4 to 6 mm from the end face of the narrow tube 12. Although the heat-resistant metal, such as niobium, forming the heat-resistant metal layer 29 is corroded by halogen at high temperature, since the heat-resistant metal layer 29 of this example is completely covered with the halogen-resistant sealing glass 30, it is protected from halogen corrosion.

In this example, the layer thickness of the sealing glass 30 is the gap between the electricity introducing member 24 and the heat-resistant metal layer 29, the gap between the heat-resistant metal layer 29 and the ceramic sleeve 28 and also the gap between the ceramic sleeve 28 and the narrow tube 12, and each layer thickness is 0.2 mm or less. If the layer thickness of the sealing glass 30 is 0.2 mm or less, it achieves excellent heat resistance and thermal shock resistance as the sealing structure.

In the arc tube 1 whose both ends are thus sealed, mercury: about 21 mg, dysprosium iodide: about 36 mg, thallium iodide: about 6 mg, cesium iodide: about 5 mg and an argon gas of about 8 kPa as the starting gas are enclosed. An electric discharge lamp as shown in FIG. 2 was fabricated by incorporating the arc tube 1 thus constructed into the vacuum external tube 3 and its characteristics in lighting it in a horizontal burning position with the electric power consumption of 700 W were measured, and consequently the following were obtained.

Tube electric power: 700 W

Tube current: 6.83 A

Tube voltage: 113.5 V

Total luminous flux: 72,100 lm

General color rendering index: 86

Color temperature: 4,330 K

Besides, when a life test was executed for this electric discharge lamp by bare and horizontal burning position and the electric power consumption of 700 W, no abnormal conditions occurred even after the elapse of about 6,000 hours.

(Thirteenth Embodiment)

Figure 16:
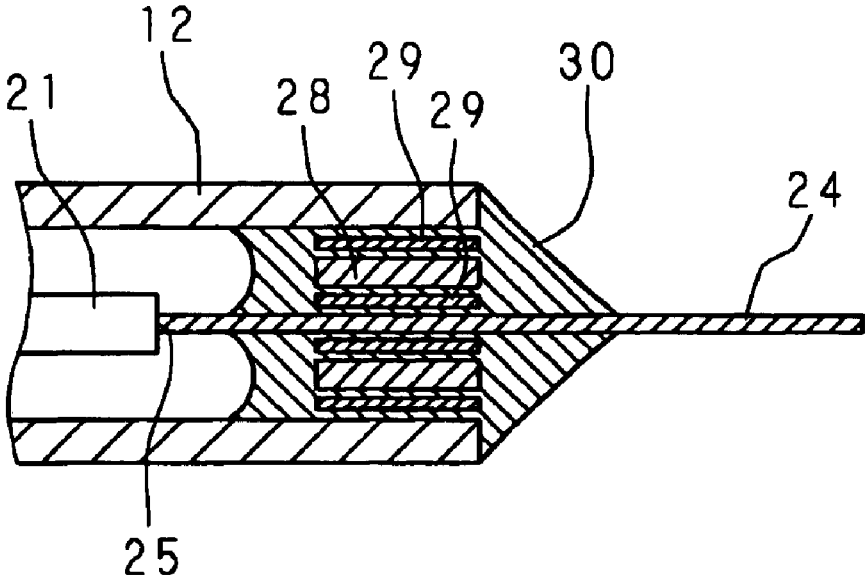
FIG. 16 is a cross sectional view showing the sealing structure of the arc tube of an electric discharge lamp according to the thirteenth embodiment.

FIG. 16 is a cross sectional view showing the sealing structure of the arc tube 1 of an electric discharge lamp according to the thirteenth embodiment of the present invention. In FIG. 16, the same sections as in FIG. 15 are designated with the same numbers, and the explanation thereof is omitted.

In this thirteenth embodiment, like the twelfth embodiment, a layered product composed of a ceramic sleeve and a heat-resistant metal layer is used as the insertion member. More specifically, the electricity introducing member 24 is airtightly sealed by the sealing glass 30 through the ceramic narrow tube 12, two layers of the heat-resistant metal layer 29 and a single layer of the ceramic sleeve 28.

(Fourteenth Embodiment)

Figure 17:
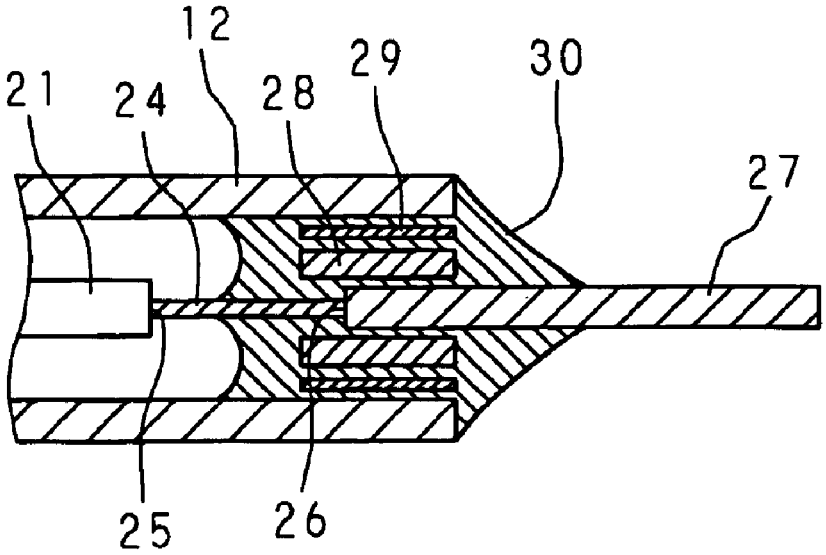
FIG. 17 is a cross sectional view showing the sealing structure of the arc tube of an electric discharge lamp according to the fourteenth embodiment.

FIG. 17 is a cross sectional view showing the sealing structure of the arc tube 1 of an electric discharge lamp according to the fourteenth embodiment of the present invention. In FIG. 17, the same sections as in FIGS. 6 and 15 are designated with the same numbers, and the explanation thereof is omitted.

In this fourteenth embodiment, like the twelfth embodiment, a layered product composed of a ceramic sleeve and a heat-resistant metal layer is used as the insertion member. More specifically, the first electricity introducing member 24 and the second electricity introducing member 27 are airtightly sealed by the sealing glass 30 through the ceramic narrow tube 12, a single layer of the ceramic sleeve 28 and a single layer of the heat-resistant metal layer 29.

Besides, according to these twelfth through fourteenth embodiments, if a combination of the ceramic sleeve 28 and the-heat-resistant layer 29 is arranged in many layers, in theory, it is possible to infinitely increase the inner diameter of the narrow tube 12.

In addition, while the above-described examples illustrated the cases where a heat-resistant metal (the first through fifth embodiments), ceramic (the sixth through eleventh embodiments), a layered product of a ceramic sleeve and a heat-resistant metal layer (the twelfth through fourteenth embodiments) are used as the insertion member provided between the electricity introducing member and the narrow tube, it is also possible to use cermets as the insertion member. More specifically, chrome-alumina, molybdenum-alumina, tungsten-alumina, etc. can be used. In the case of using cermets, it is possible to obtain a suitable coefficient of linear expansion by adjusting the mixing ratio of metal and metal oxide. For example, in the case of chrome-alumina, the coefficient of linear expansion of 77Cr-23 $Al_2O_3$ is $8.9\times10^{-6}/°$ C., and thus the chrome-alumina is usable as the insertion member.

Industrial Applicability

As described above, in an electric discharge lamp of the present invention, since the insertion member is provided in a part of the region between the electricity introducing member and the narrow tube, even when the diameter of the electricity introducing member and the inner diameter of the narrow tube are increased, it is possible to decrease the layer thickness of the sealing glass, thereby providing an electric discharge lamp having excellent life and large electrical power consumption.

Moreover, according to the present invention, since the stress buffering member made of a heat-resistant metal is provided between the electricity introducing member and the narrow tube, thermal stress based on the difference in the coefficients of linear expansion between the electricity introducing member and the sealing glass is absorbed by the stress buffering member member and the reliability of the sealed section is improved, thereby providing an electric discharge lamp having an excellent life characteristic.

Furthermore, according to the present invention, since the difference between the inner diameter of the narrow tube and the outer diameter of the ceramic sleeve is made within a range of 0.02 to 0.6 mm, cracks are not caused during the sealing process, thereby establishing a reliable sealing technique.

In addition, according to the present invention, since the inner diameter of the narrow tube is made 1.3 mm or more, it is possible to use large electrodes, thereby enabling practical application of an electric discharge lamp of large electric power consumption. Further, since the difference between the flow-in length of the sealing glass into the narrow tube and the insertion length of the second electricity introducing member into the narrow tube is made 1.0 mm or more, it is possible to achieve the glass seal section having excellent durability and provide an electric discharge lamp having an excellent life characteristic and large electric power consumption.

Besides, according to the present invention, since the diameter of the first electricity introducing member is made not less than 0.3 mm but not more than 0.7 mm, it is possible to ensure the reliable sealed section and provide an electric discharge lamp having excellent life and large electric power consumption.

Furthermore, according to the present invention, since the layer thickness of the sealing glass is reduced by providing a single layer or a plurality of layers of ceramic sleeve and heat-resistant metal layer between the electricity introducing member and the narrow tube, it is possible to apply this invention to a lamp of large electric power consumption using a ceramic arc tube comprising a narrow tube with a large inner diameter and to provide an electric discharge lamp having an excellent life characteristic and large electric power consumption.

What is claim is:

1. An electric discharge lamp in which a filler containing a metal halide and capable of being ionized is enclosed in an arc tube made of translucent ceramic with a small-diameter section formed at both ends comprising:

an electricity introducing member inserted into said small-diameter section;

a glass sealant airtightly fixing said electricity introducing member; and an insertion member provided between said electricity introducing member and said small-diameter section, wherein said glass sealant fills spaces between said electricity introducing member and said insertion member and between said insertion member and said small-diameter section, and wherein all surfaces of said insertion member are covered with said glass sealant thereby separating the insertion member from the filler.

2. The electric discharge lamp of claim 1, wherein said insertion member is a material having no halogen resistance.

3. An electric discharge lamp according to claim 2, further comprising:

an electrode core connected to said electricity introducing member and inserted into said small-diameter section; and a metallic coil, which is in said small-diameter section, wound round said electrode core.

4. The electric discharge lamp as set forth in claim 2, wherein said glass sealant is a mixture containing Al2O3, SiO2, and an oxide of a rare-earth element.

5. The electric discharge lamp as set forth in claim 4, wherein said glass sealant is an Al2O3-SiO2-Dy2O3 based mixture.

6. The electric discharge lamp as set forth in claim 5, wherein a composition of said glass sealant is Al2O3: 17±3 weight %, SiO2: 22±3 weight %, and Dy2O3: 61±3 weight %.

7. The electric discharge lamp as set forth in claim 1, wherein said translucent ceramic is a translucent alumina.

8. The electric discharge lamp as set forth in claim 2, wherein said insertion member is a heat-resistant metal.

9. The electric discharge lamp as set forth in claim 2, wherein a material of said insertion member is ceramic.

10. The electric discharge lamp as set forth in claim 2, wherein said insertion member comprises a single layer or a plurality of layers of ceramic sleeve, and a single layer or a plurality of layers of heat-resistant metal.

11. The electric discharge lamp as set forth in claim 2, wherein the heat-resistant metal of said insertion member is selected from the group consisting of niobium, tantalum, iridium, rhodium, vanadium, titanium, platinum, alloys of niobium, alloys of tantalum, alloys of iridium, alloys of rhodium, alloys of vanadium, alloys of titanium and alloys of platinum.

12. The electric discharge lamp as set forth in claim 10, wherein the heat-resistant metal of said insertion member is selected from the group consisting of niobium, tantalum, iridium, rhodium, vanadium, titanium, platinum, alloys of niobium, alloys of tantalum, alloys of iridium, alloys of rhodium, alloys of vanadium, alloys of titanium and alloys of platinum.

13. The electric discharge lamp as set forth in claim 8, wherein a coefficient of linear expansion of the heat-resistant metal of said insertion member at 0 to 1000° C. is 6.5×10−6/° C. or more.

14. The electric discharge lamp as set forth in claim 10, wherein a coefficient of linear expansion of the h at-resistant metal of said insertion member at 0 to 1000° C. is 6.5×10−6/° C. or more.

15. The electric discharge lamp as set forth in claim 9, wherein the translucent ceramic of said arc tube and the ceramic of said insertion member are the same material or have similar coefficients of linear expansion.

16. The electric discharge lamp as set forth in claim 10, wherein the translucent ceramic of said arc tube and the ceramic of said insertion member are the same material or have similar coefficients of linear expansion.

17. The electric discharge lamp as set forth in claim 9, wherein the ceramic of said insertion member contains at least one kind selected from the group consisting of alumina, titania spinel and beryllia.

18. The electric discharge lamp as set forth in claim 10, wherein the ceramic of said insertion member contains at least one kind selected from the group consisting of alumina, titania, spinel and beryllia.

19. The electric discharge lamp as set forth in claim 9, wherein a coefficient of linear expansion of the ceramic of said insertion member at 20 to 1000° C. is 8.9×10−6/° C. or less.

20. The electric discharge lamp as set forth in claim 10, wherein a coefficient of linear expansion of the ceramic of said insertion member at 20 to 1000° C. is 8.9×10−6/° C. or less.

21. The electric discharge lamp as set forth in claim 2, wherein said insertion member is a cermet.

22. The electric discharge lamp as set forth in claim 2, wherein said electricity introducing member is selected from the group consisting of tungsten, molybdenum, alloys of tungsten and alloys of molybdenum.

23. The electric discharge lamp as set forth in claim 2, wherein said small-diameter section is formed of a narrow tube.

24. The electric discharge lamp as set forth in claim 9, wherein said small-diameter section is formed of a narrow tube, said insertion member is a ceramic sleeve, and a relation $$0.02 \leqq A-B \leqq 0.60 \text{ mm}$$

is satisfied, where A mm is an inner diameter of said narrow tube and B (mm) is an outer diameter of said ceramic sleeve.

25. The electric discharge lamp as set forth in claim 2, wherein said electricity introducing member comprise a halogen-resistant first member arranged on an electrode side and a second member whose coefficient of linear expansion is similar to that of said translucent ceramic, said insertion member is provided between said first member and said small-diameter section, and a junction between said first and second members is covered with said glass sealant.

26. The electric discharge lamp as set forth in claim 25, wherein said small-diameter section is formed of a narrow tube with an inner diameter of 1.3 mm or more, said first member is connected to said electrode, and a relation $$D-C \geqq 1.0 \text{ mm}$$

is satisfied, where C mm is an insertion length of said second member into said narrow tube and D mm is a flow-in length of said glass sealant into said narrow tube.

27. The electric discharge lamp as set forth in claim 25, wherein said first member is selected from the group consisting of molybdenum, alloys of molybdenum and cermet.

28. The electric discharge lamp as set forth in claim 26, wherein said first member is selected from the group consisting of molybdenum, alloys of molybdenum and cermet.

29. The electric discharge lamp as set forth in claim 25, wherein a diameter of said first member is not less than 0.3 mm but not more than 0.7 mm.

30. The electric discharge lamp as set forth in claim 26, wherein a diameter of said first member is not less than 0.3 mm but not more than 0.7 mm.

31. The electric discharge lamp as set forth in claim 25, wherein said second member is selected from the group consisting of niobium, alloys of niobium, tantalum and alloys of tantalum.

32. The electric discharge lamp as set forth in claim 26, wherein said second member is selected from the group consisting of niobium, alloys of niobium, tantalum and alloys of tantalum.

33. The electric discharge lamp of claim 1, wherein said insertion member is a material that may be susceptible to halogen degradation.

* * * * *